US009573161B2

(12) United States Patent
Goodwin, Jr. et al.

(10) Patent No.: US 9,573,161 B2
(45) Date of Patent: Feb. 21, 2017

(54) PAINT ROLLER AND METHOD OF ASSEMBLING THE SAME

(71) Applicant: The Sherwin-Williams Company, Cleveland, OH (US)

(72) Inventors: Edward Ray Goodwin, Jr., Westlake, OH (US); Charles T. Buckel, Jr., Valley City, OH (US); Michael C. Lambertson, Jr., Aurora, OH (US)

(73) Assignee: The Sherwin-Williams Company, Cleveland, OH (US)

( * ) Notice: Subject to any disclaimer, the term of this patent is extended or adjusted under 35 U.S.C. 154(b) by 0 days.

(21) Appl. No.: 14/862,867

(22) Filed: Sep. 23, 2015

(65) Prior Publication Data

US 2016/0089690 A1 Mar. 31, 2016

Related U.S. Application Data

(60) Provisional application No. 62/057,942, filed on Sep. 30, 2014.

(51) Int. Cl.
*B05C 17/02* (2006.01)

(52) U.S. Cl.
CPC ..... *B05C 17/0205* (2013.01); *B05C 17/02* (2013.01); *B05C 17/022* (2013.01)

(58) Field of Classification Search
CPC ..... B05C 17/02; B05C 17/0205; B05C 17/022
USPC ..... 15/105, 144.1, 144.2
See application file for complete search history.

(56) References Cited

U.S. PATENT DOCUMENTS

| | | | | |
|---|---|---|---|---|
| 3,335,446 | A | 8/1967 | McGinley | |
| 3,711,887 | A | 1/1973 | Chapman | |
| 4,332,067 | A | 6/1982 | Pearce | |
| 2007/0130714 | A1* | 6/2007 | Williams | B05C 17/022 15/230.11 |
| 2007/0186362 | A1* | 8/2007 | Felix | B05C 17/0245 15/105 |
| 2007/0251042 | A1* | 11/2007 | Kim | B05C 17/02 15/230.11 |
| 2007/0256268 | A1* | 11/2007 | Mertins | B05C 17/02 15/230.11 |
| 2010/0095469 | A1* | 4/2010 | Hu | B05C 17/02 15/230.11 |

(Continued)

FOREIGN PATENT DOCUMENTS

| | | |
|---|---|---|
| BE | 725908 | 2/1969 |
| EP | 0769330 | 4/1977 |

(Continued)

OTHER PUBLICATIONS

International Search Report and Written Opinion for PCT Application No. PCT/US2015/052621, issued Dec. 15, 2015.

*Primary Examiner* — Michael Jennings
(74) *Attorney, Agent, or Firm* — Daniel A. Sherwin; Emerson, Thomson & Bennett, LLC; Roger Emerson

(57) ABSTRACT

Provided is a paint roller which includes a handle connected to one end of a wire frame and a cage connected to an opposite end of the wire frame onto which a paint roller cover may be positioned and engaged over. The handle may include an insert or adapter allowing for connecting various types of extension poles. The cage may be connected through the wire frame through the use of bearings and bushings.

21 Claims, 45 Drawing Sheets

(56) References Cited

U.S. PATENT DOCUMENTS

| | | | | |
|---|---|---|---|---|
| 2011/0030161 | A1* | 2/2011 | Gurr | B05C 17/02 15/230.11 |
| 2013/0239351 | A1* | 9/2013 | Wang | B05C 17/0225 15/230.11 |
| 2013/0340192 | A1* | 12/2013 | Decarr | B05C 17/0225 15/230.11 |

FOREIGN PATENT DOCUMENTS

| | | |
|---|---|---|
| FR | 2832081 | 5/2003 |
| GB | 735895 | 8/1955 |
| GB | 761756 | 11/1956 |
| GB | 761772 | 11/1956 |
| GB | 2399522 | 9/2004 |

* cited by examiner

PAINT ROLLER AND METHOD OF ASSEMBLING THE SAME

I. BACKGROUND

A. Technical Field

Provided is a paint roller for applying paint and other paint-like materials to walls, ceilings, floors and other substrates. Also provided is a method for assembling a paint roller.

B. Description of Related Art

It is well known in the paint industry to provide painters with access to paint rollers which can be used to more efficiently paint over large surface areas on walls, ceilings, floors and other substrates. It is known, for example, to provide a paint roller having a handle; a wire frame having at least two longitudinal portions, three bends and two horizontal portions; a rotatable and cylindrical cage assembly positioned over one end of the wire frame which includes various mechanical components allowing attachment of the cage assembly to the wire frame and rotation of the cage assembly relative to the wire frame; and a cylindrical paint holder cover may be positioned by sliding over the cage assembly.

While many known paint rollers used in the paint industry work well for their intended purposes, they have several disadvantages. First, not all paint roller handles are capable of being connected to extension poles and extension pole connection adapters provided from different manufacturers. Another disadvantage is that many paint rollers are manufactured to incorporate swedges into the wire frame. These swedges are often used in conjunction with washers to hold the roller portion of a paint roller assembly in its proper position along the wire frame. The use of swedges in paint rollers for this purpose provides several disadvantages. First, it requires the use of additional components to secure the cage to the wire frame which adds expense and complexity to the cage assembly and the manufacturing and assembly process. Second, the swedge and washer combination can result in a significant amount of play between the cage assembly and the wire frame which can adversely affect the efficiency and quality of the painting process. Furthermore, the presence of swedges on the wire frame can scrape against the side of a container as the roller assembly is being used causing dried paint to fall into the paint held in the container. This dried paint, when mixed with the paint to be applied and picked up by the paint roller, can result in unsightly aberrations or deformations in the paint coating that is applied to a wall or other substrate. Another disadvantage of current paint rollers is that paint roller covers have a tendency to become disengaged from or "walk off" of the cage assembly as the user applies paint with the paint roller.

What is needed is an apparatus that can solve these problems and provide a universal connection mechanism for various types of extension poles and extension pole adapters, an apparatus that provides a more efficient, effective and economical way to engage a roller portion to the wire frame of a paint roller without the disadvantages of using a swedge to accomplish such an engagement; and an apparatus that can more effectively secure a paint roller cover to the roller portion of a paint roller.

II. SUMMARY

Provided is a paint roller. The paint roller may include the following components: a wire frame having a first end and a second end, wherein the first end of the wire frame extends from a first longitudinal portion to a first bend, which extends to a first horizontal portion, which extends to a second bend, which extends to a second longitudinal portion, which extends to a third bend, which extends to a second horizontal portion at the second end of the wire frame; a handle having a first end and a second end wherein the first end of the handle is engaged to the first end of the wire frame; a first aperture and a second aperture positioned at a first end and a second end of the second horizontal portion at the second end of the wire frame; a first bearing having a first internal chamber which is aligned with the first aperture of the wire frame and a second internal chamber substantially perpendicular to the first internal chamber which receives a portion of the wire frame; a second bearing having a first internal chamber which is aligned with the second aperture of the wire frame and a second internal chamber substantially perpendicular to the first internal chamber which receives a portion of the wire frame; a pin inserted through the first internal chamber of the first bearing and the first aperture on the wire frame; a pin inserted through the first internal chamber of the second bearing and the second aperture on the wire frame; a first bushing having a substantially cylindrical body having an outer wall and an inner wall defining an internal chamber, a closed end and an open end, wherein the first bushing includes an aperture within the closed end that allows it to be positioned at the first end of the second horizontal portion at the second end of the wire frame; a second bushing having a substantially cylindrical body having an outer wall and an inner wall defining an internal chamber a closed end and an open end, wherein the second bushing is positioned at the second end of the second horizontal portion at the second end of the wire frame; and a roller having a first end and a second end, wherein the roller is engaged to the second horizontal portion at the second end of the wire frame through the first and second bearing and the first and second bushing.

According to further embodiments, the paint roller may include a roller which is shape of a cylindrical piece having a first end, a second end and a cylindrically consistent smooth surface, wherein the roller has a radially expanded portion at its first end and a radially expanded portion at its second end relative to its interior portion and wherein the first and second ends of the roller respectively engage a first and second bushing.

According to further embodiments, the paint roller may include a roller which is a cage having at least two lateral elements and at least two circular elements substantially perpendicular to the lateral elements, wherein one circular element is positioned at the first end and one circular element is positioned at the second end of the cage, a first rim adjacent to the circular element at the first end of the cage, and a second rim adjacent to the circular element at the second end of the cage.

According to further embodiments, the paint roller may include a handle having a first projecting edge and a second projecting edge both of which are positioned at the first end of the handle.

According to further embodiments, the second end of the handle may be engaged to an insert comprising an insert body having an interior chamber, a first end and a second end; wherein the first end of the insert is engaged to the handle and the second end of the insert functions as an adapter designed to engage an extension pole system.

According to further embodiments, the insert may include an insert flange having a top portion and a bottom portion, wherein the top portion of the insert flange comprises at least one U-shaped recess and the bottom portion of the insert flange comprises concave features.

According to further embodiments, the U-shaped recess on the top portion of the insert flange form holes into which an actuator pin of an extension pole system may engage and wherein the concave features on the bottom portion of the insert flange may be designed to prevent relative rotation of an extension pole system with the insert when the extension pole system is engaged to the insert.

According to further embodiments, the insert may include two areas of insert ribs that extend axially on the top and bottom of the interior of the insert and two areas of smooth surfaces that extend axially on the interior sides of the insert which may be designed to engage an extension pole system.

According to further embodiments, the first bearing and the second bearing may include a shoulder portion adjacent to the cylindrical portion of the second internal chamber.

According to further embodiments, the internal chamber of the first and second bushing may include at least two spokes extending from a centrally positioned hub.

According to further embodiments, the hub of the first and second bushing may include a substantially cylindrical frame having a hollow interior.

According to further embodiments, the hub of the first bushing may be capable of receiving the cylindrical portion of the second internal chamber of the first bearing and the hub of the second bushing may be capable of receiving the cylindrical portion of the second internal chamber of the second bearing.

According to further embodiments, the frame of the hub of the first bushing may be capable of contacting the shoulder portion of the first bearing and the frame of the hub of the second bushing may be capable of contacting the shoulder portion of the second bearing.

According to further embodiments, the first bushing and the second bushing may have a frusto-conical shape.

According to further embodiments, the cage may include four lateral elements and six circular elements substantially perpendicular to the lateral elements wherein one circular element is positioned at the first end of the cage and one circular element is positioned at the second end of the cage, wherein the lateral elements may be spaced at equidistant points relative to each other along the cage and wherein the circular elements may be spaced at equidistant points relative to each other along the cage.

According to further embodiments, the rim at the first end of the cage may include a recess along the circumference of the rim which allows for the first end of the cage to engage an internal protrusion along the inner wall of the first bushing and wherein the rim at the second end of the cage includes a recess along the circumference of the rim which allows for the second end of the cage to engage an internal protrusion along the inner wall of the second bushing.

According to further embodiments, the first circular element at the first end of the cage and the second circular element at the second end of the cage may have an increased diameter relative to the circular elements positioned internally along the body of the cage and the lateral elements may be tapered outwardly at the first and second ends of the cage to connect to the first circular element at the first end of the cage and the second circular element at the second end of the cage.

According to further embodiments, the outer wall of the cylindrical body of the first bushing may include external ribs spaced at various points along the outer wall.

According to further embodiments, the closed end of the first bushing may include a cylindrical cover having a diameter that is greater than the diameter of the cylindrical body of the first bushing so that the cylindrical cover forms a substantially circular rim over the cylindrical body and the external ribs on the cylindrical body of the first bushing may extend short of the cylindrical cover forming a gap between the circular rim and the external ribs.

Also provided is a method of assembling a paint roller. The method may include the following steps: forming a wire frame having a first end and a second end, wherein the first end of the wire frame extends from a first longitudinal portion to a first bend, which extends to a first horizontal portion, which extends to a second bend, which extends to a second longitudinal portion, which extends to a third bend, which extends to a second horizontal portion at the second end of the wire frame; forming a first aperture and a second aperture positioned at a first end and a second end of the second horizontal portion at the second end of the wire frame; engaging a first end of a handle to the first end of the wire frame; positioning a first bushing over a first end of the second horizontal portion at the second end of the wire frame wherein the first bushing comprises a substantially cylindrical body having an outer wall and an inner wall defining an internal chamber, a closed end and an open end, wherein the internal chamber of the first bushing includes at least two spokes extending from a centrally positioned hub, wherein the hub comprises a substantially cylindrical frame having a hollow interior and wherein the first bushing includes an aperture within the closed end that allows it to be positioned at the first end of the second horizontal portion at the second end of the wire frame; aligning a first bearing with the first aperture at the second horizontal portion at the second end of the wire frame and engaging the first bearing to the wire frame; aligning a second bearing with the second aperture at the second horizontal portion at the second end of the wire frame and engaging the second bearing to the wire frame; positioning a roller having a first end and a second end over the second horizontal portion at the second end of the wire frame and engaging the first end of the roller to the first bushing; positioning a second bushing over the second horizontal portion at the second end of the wire frame and engaging the second bushing to the second end of the roller, wherein the second bushing comprises a substantially cylindrical body having an outer wall and an inner wall defining an internal chamber a closed end and an open end, wherein the internal chamber of the second bushing includes at least two spokes extending from a centrally positioned hub, wherein the hub comprises a substantially cylindrical frame having a hollow interior and which is capable of receiving the cylindrical portion of the second internal chamber of the second bearing and further wherein the frame of the hub is capable of contacting the shoulder portion of the second bearing.

Other benefits and advantages of this invention will become apparent to those skilled in the art to which it pertains upon reading and understanding of the following detailed specification.

III. BRIEF DESCRIPTION OF THE DRAWINGS

The disclosed paint roller and corresponding methods may take physical form in certain parts and arrangement of parts, embodiments of which will be described in detail in this specification and illustrated in the accompanying drawings which form a part hereof and wherein:

FIG. 6 is a bottom view of the stem of the wire for the frame shown in

FIG. 5.

Figure 6:
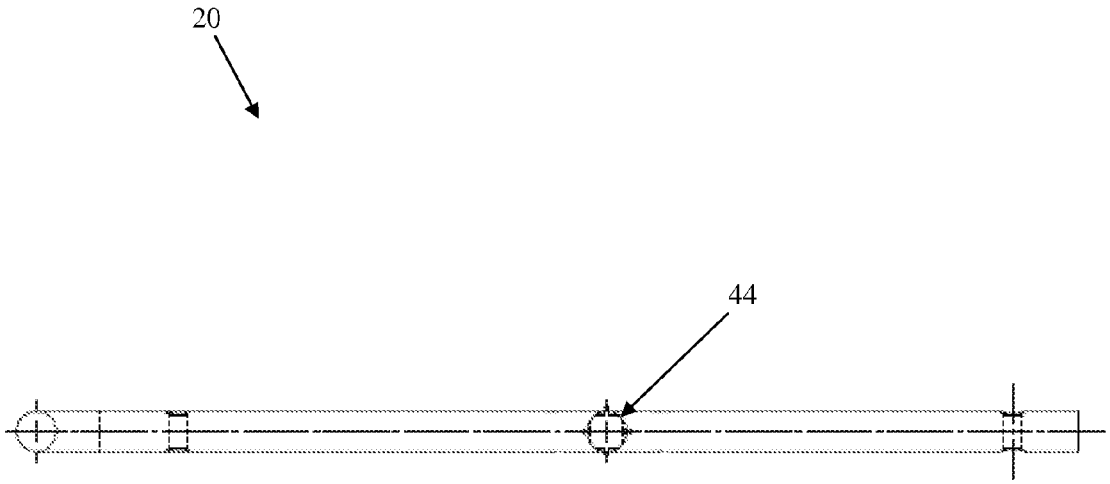
Figure 7:
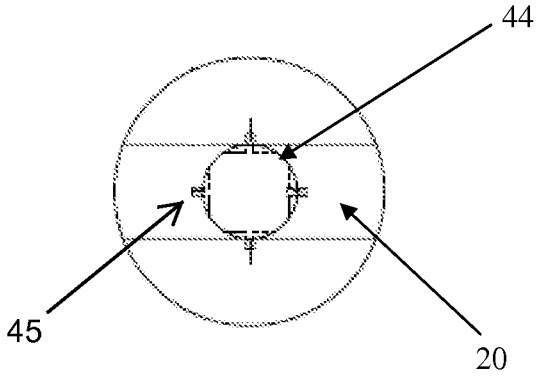

FIG. 7 is a detail view of a swedge on the wire for the frame shown in FIG. 6.

Figure 8:
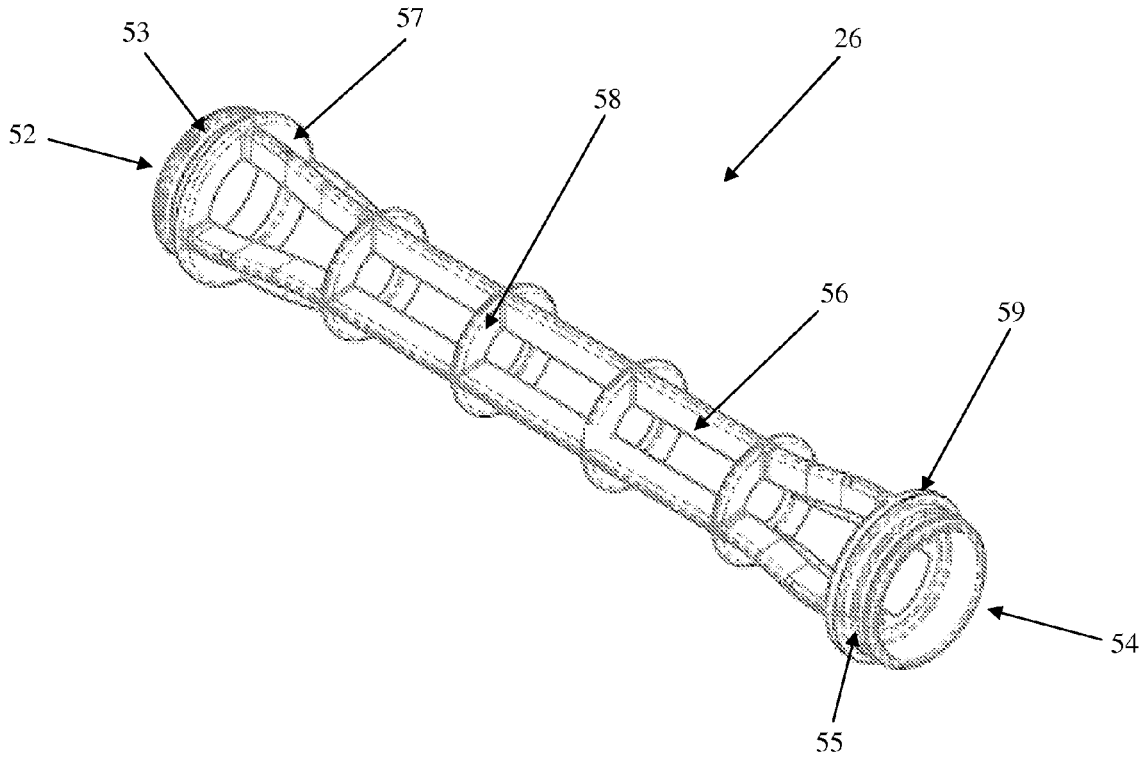

FIG. 8 is a perspective view of an exemplary cage for a roller assembly.

Figure 9:
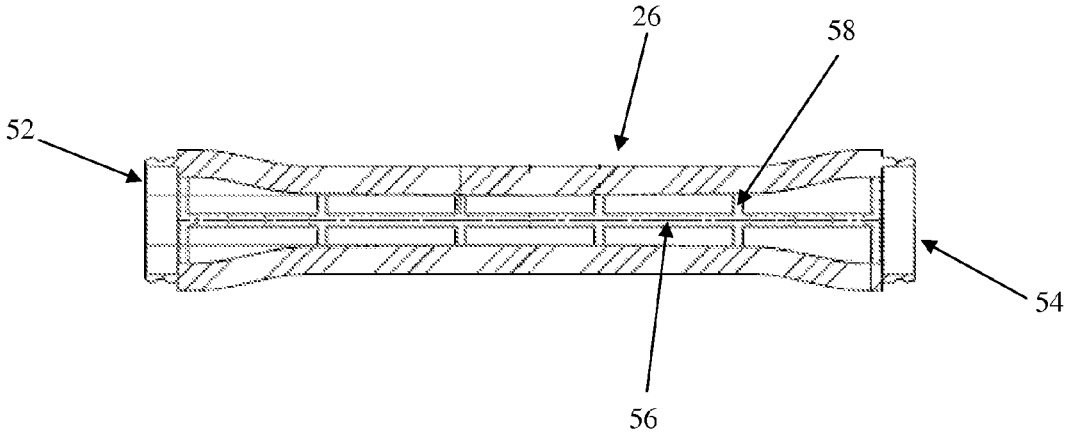

FIG. 9 is front cross-sectional view of the cage shown in FIG. 8.

Figure 10:
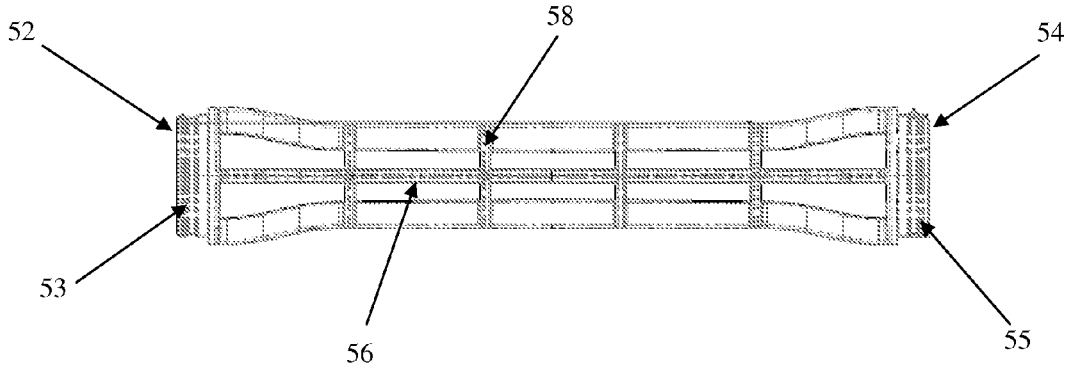

FIG. 10 is a front planar view of the cage shown in FIG. 8.

Figure 11:
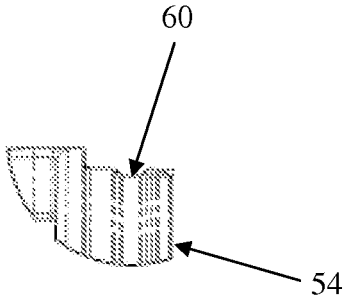

FIG. 11 is a detail view of an end of the cage shown in FIG. 10.

Figure 12:
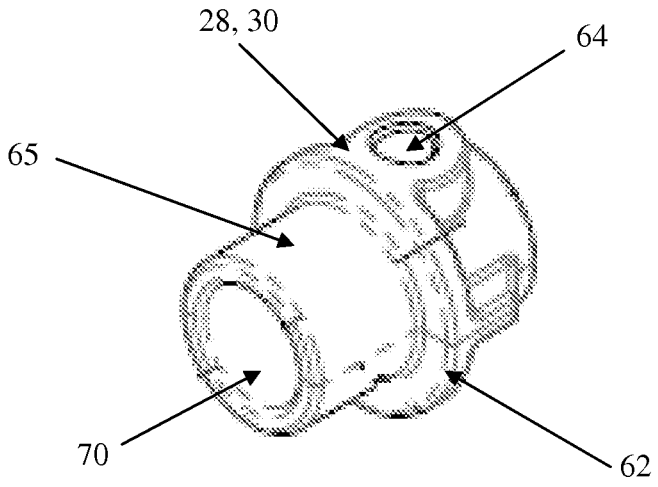

FIG. 12 is a perspective view of an exemplary bearing which may be utilized in a roller assembly.

Figure 13:
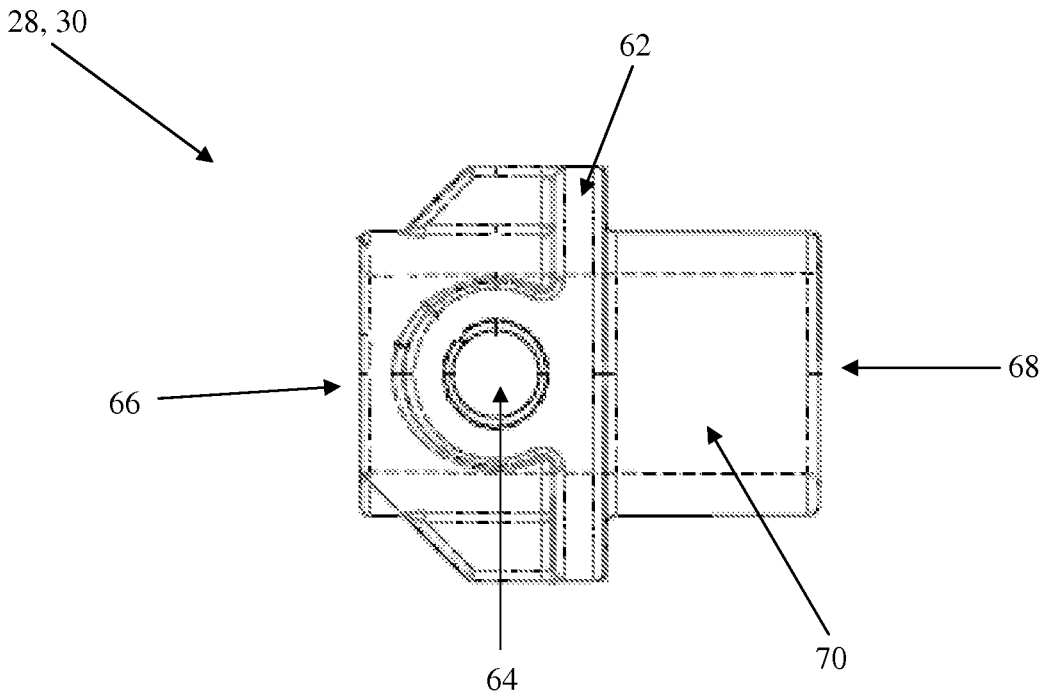

FIG. 13 is a side planar view of the bearing shown in FIG. 12.

Figure 14:
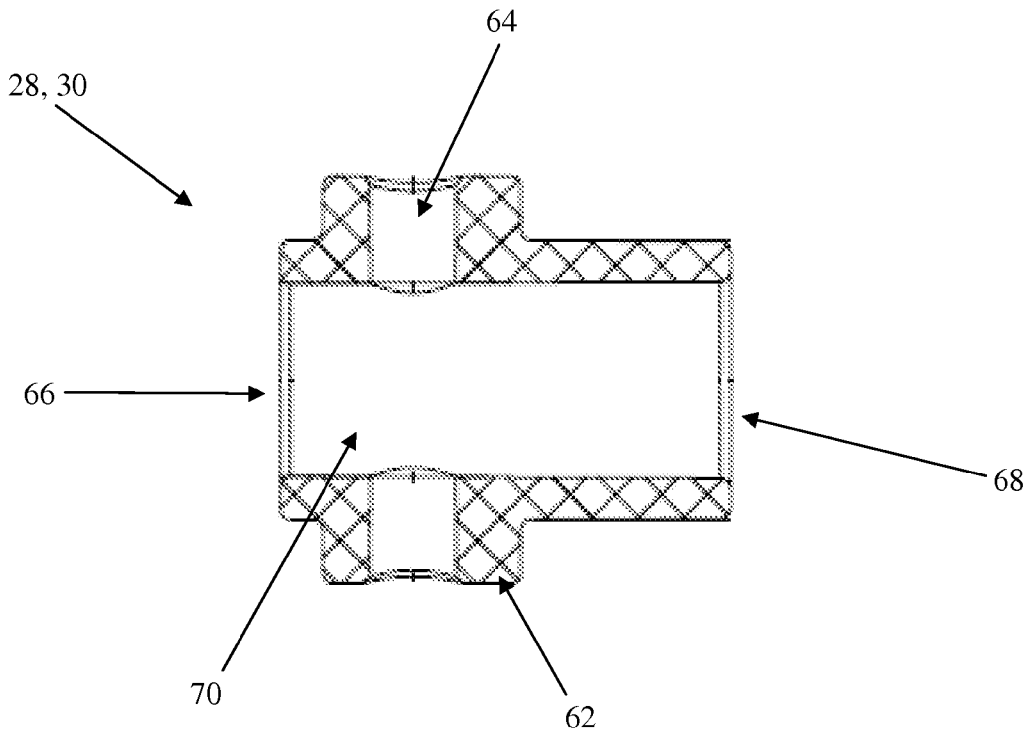

FIG. 14 is a cross-sectional side view of the bearing shown in FIG. 12.

Figure 15:
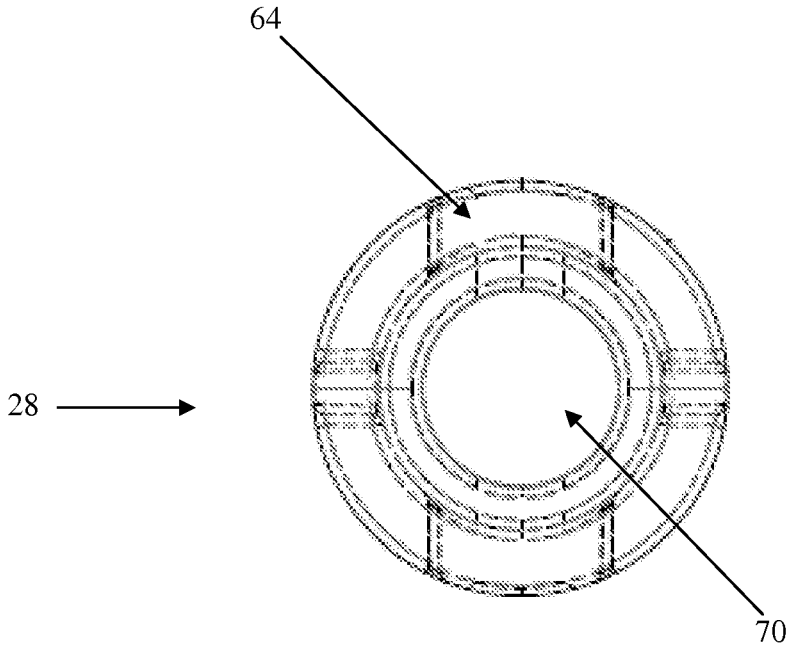

FIG. 15 is a top view of the bearing shown in FIG. 12.

Figure 16:
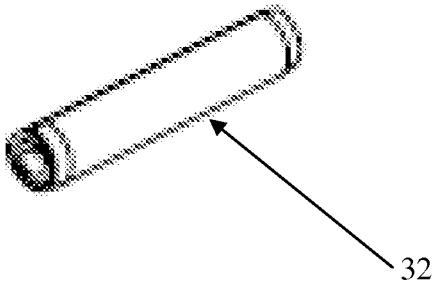

FIG. 16 is a perspective view of an exemplary bearing pin utilized in the roller assembly.

Figure 17:
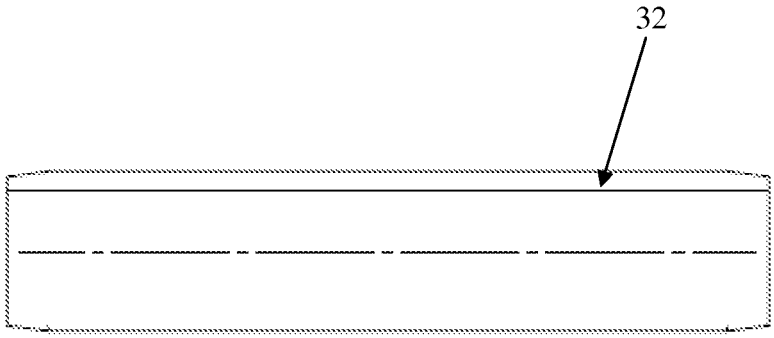

FIG. 17 is a side view of the bearing pin of FIG. 16.

Figure 18:
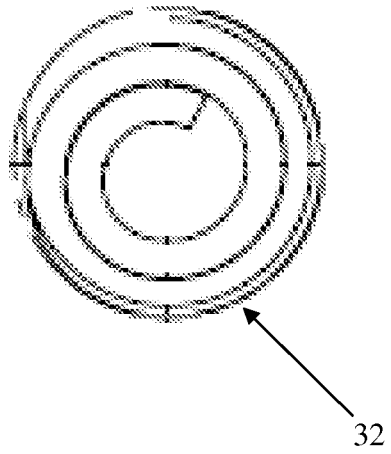

FIG. 18 is a cross-sectional front view of the bearing pin of FIG. 16.

Figure 19:
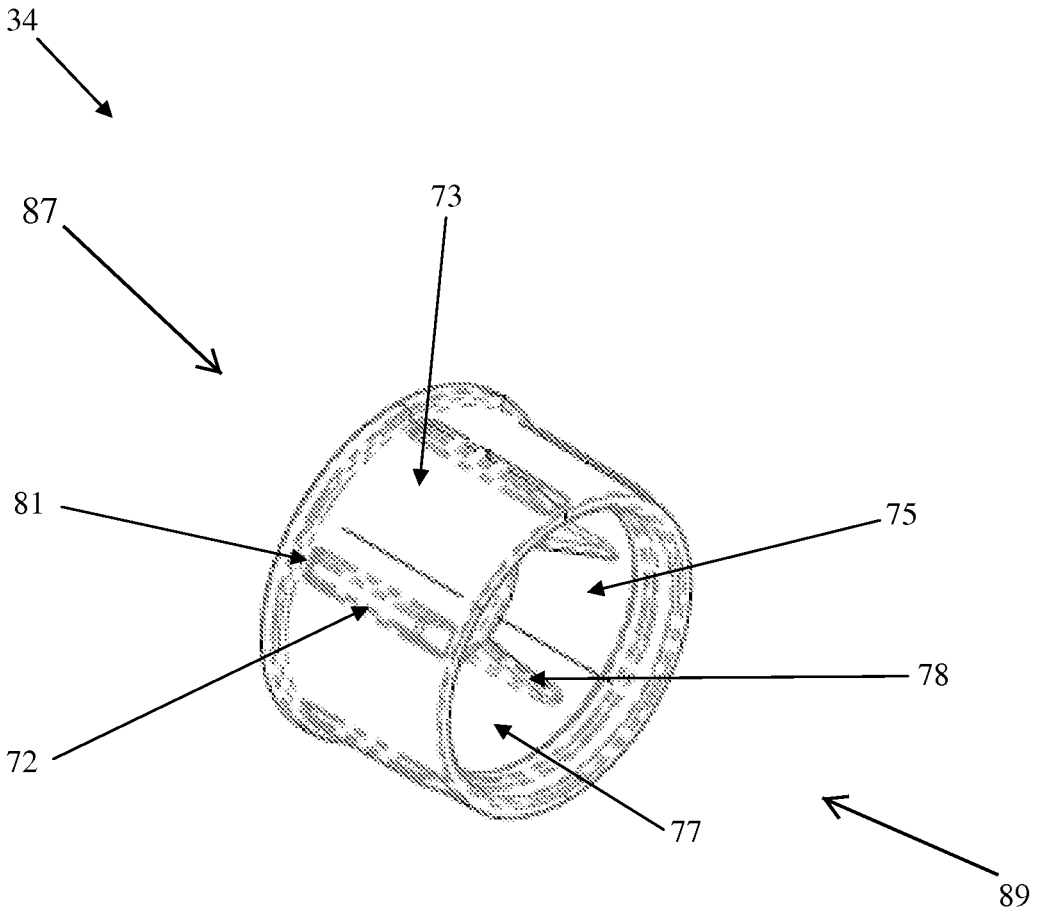

FIG. 19 is a perspective view of an exemplary inner bushing utilized in the roller assembly.

Figure 20:
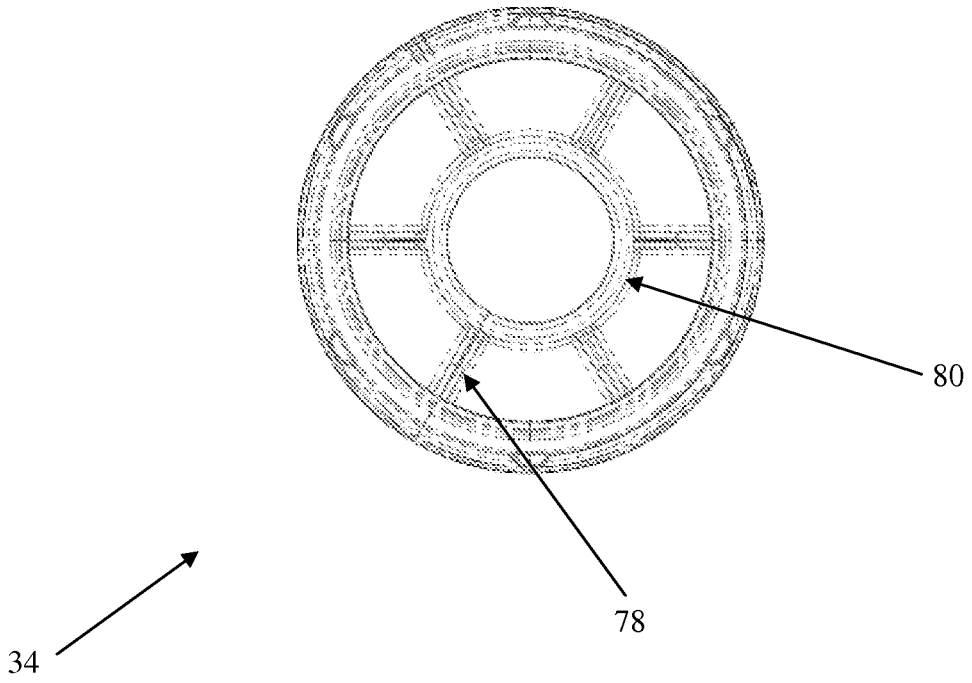

FIG. 20 is a hidden line view of the interior of inner bushing shown in FIG. 19.

Figure 21:
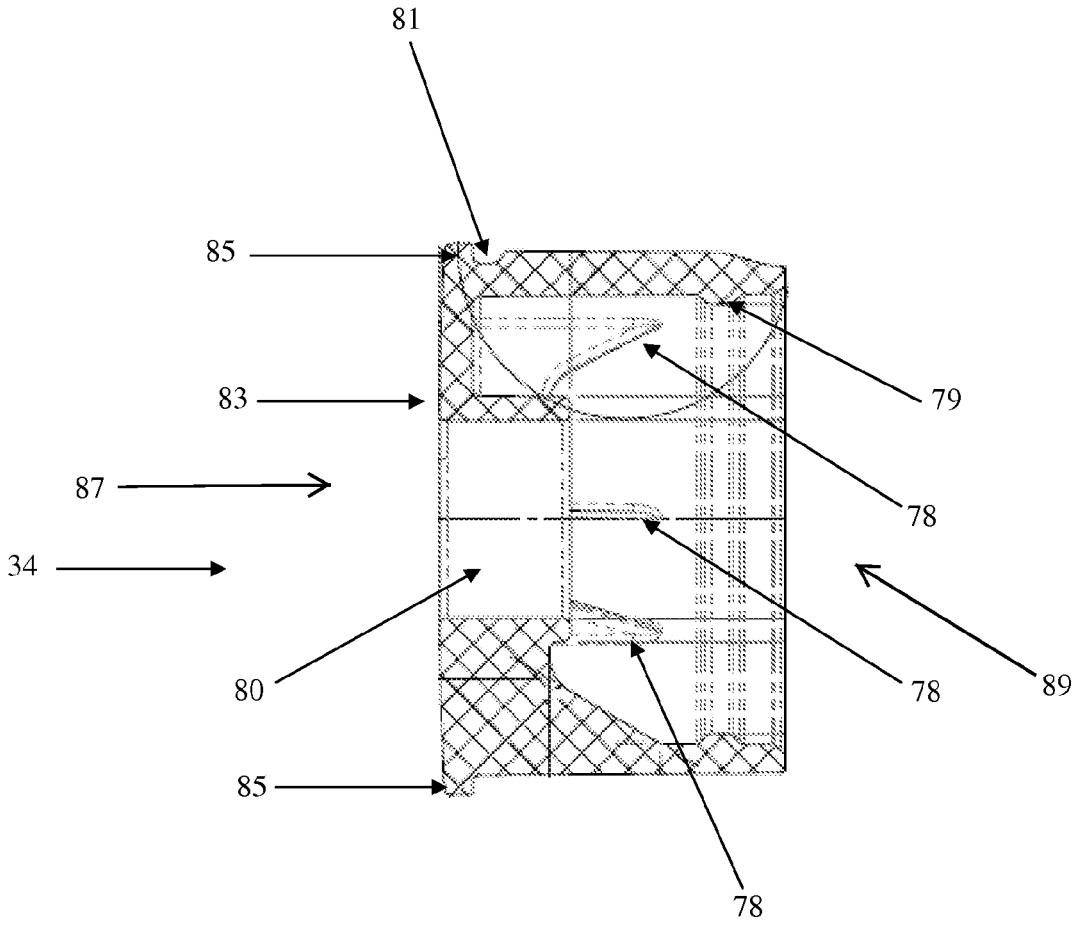

FIG. 21 is a cross-sectional side view of the inner bushing shown in FIG. 19.

Figure 22:
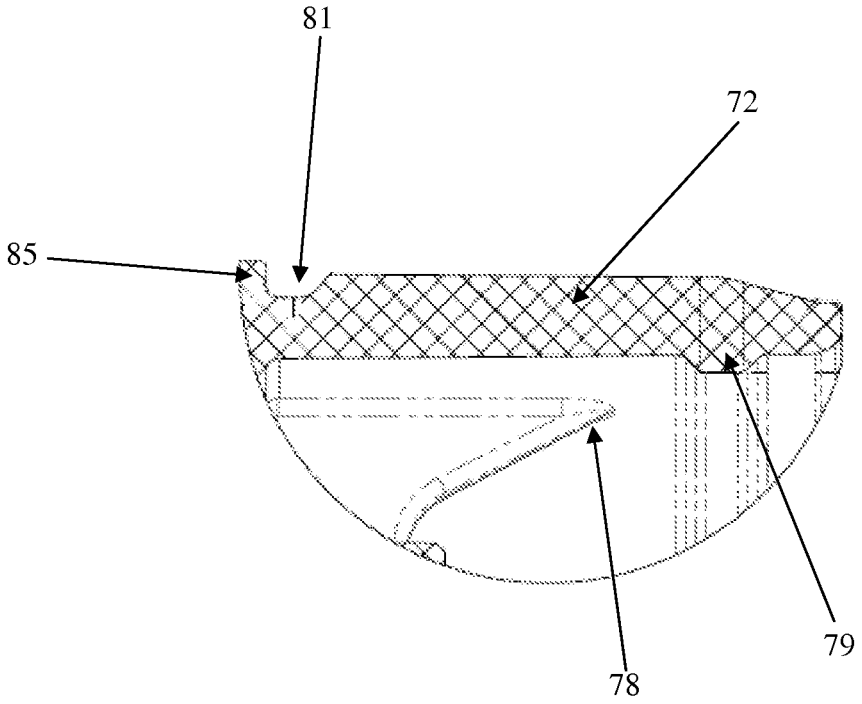

FIG. 22 is a cross-sectional view of the edge of the inner bushing shown in FIG. 19.

Figure 23:
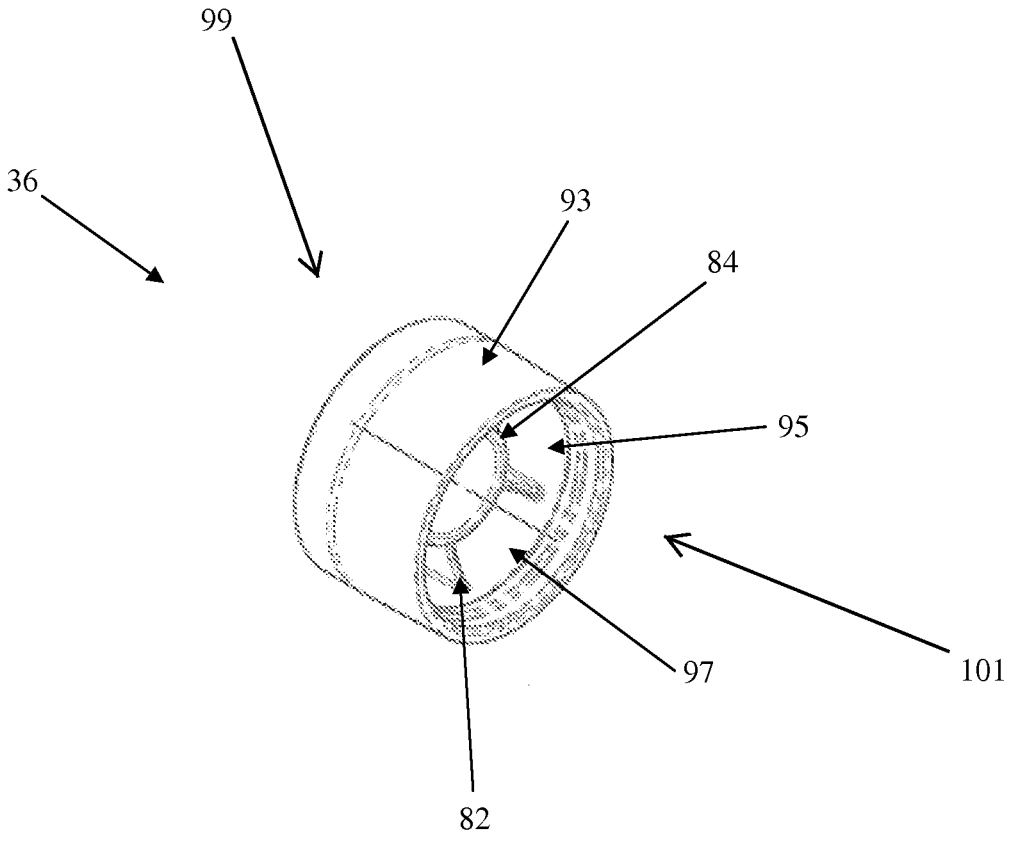

FIG. 23 is a perspective view of an exemplary outer bushing.

Figure 24:
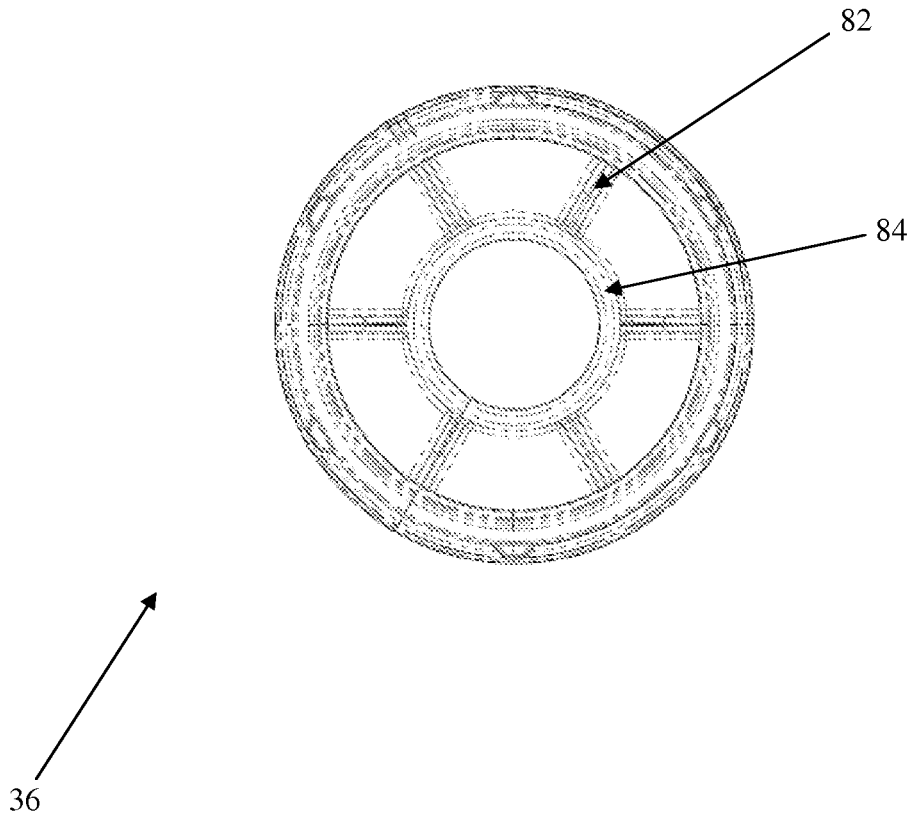

FIG. 24 is a hidden line view of the interior of the outer bushing shown in FIG. 23.

Figure 25:
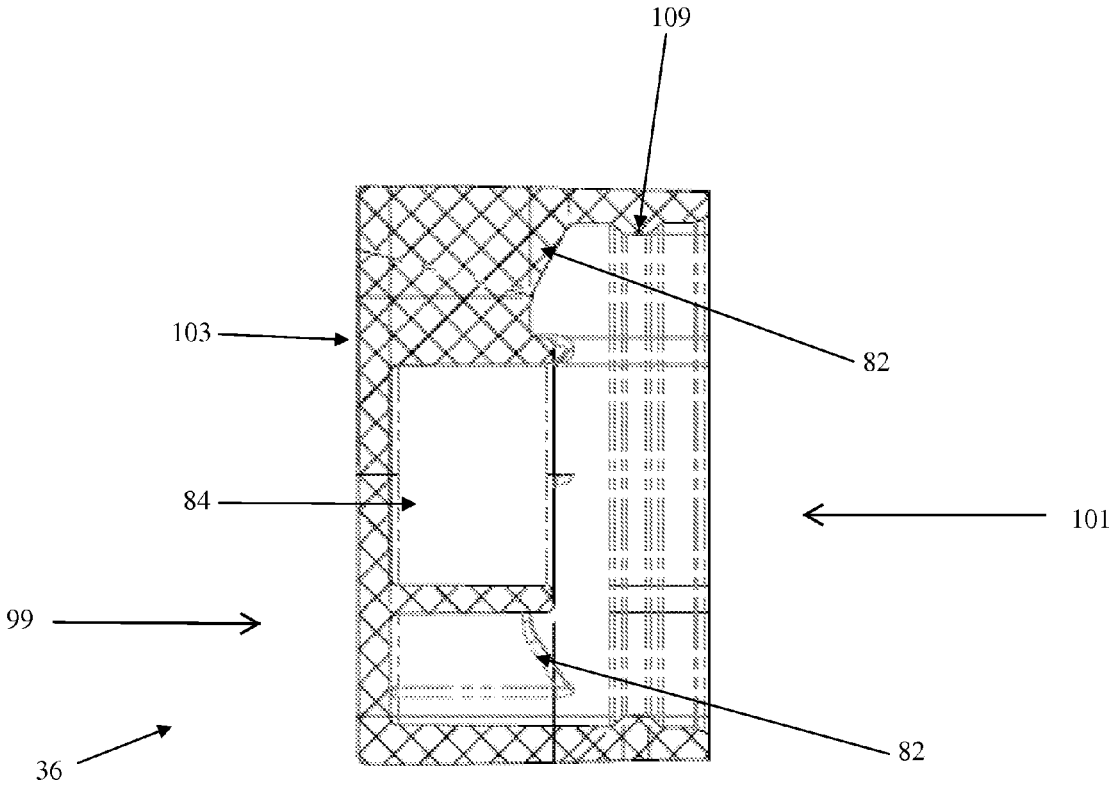

FIG. 25 is a cross-sectional side view of the outer bushing shown in FIG. 23.

Figure 26:
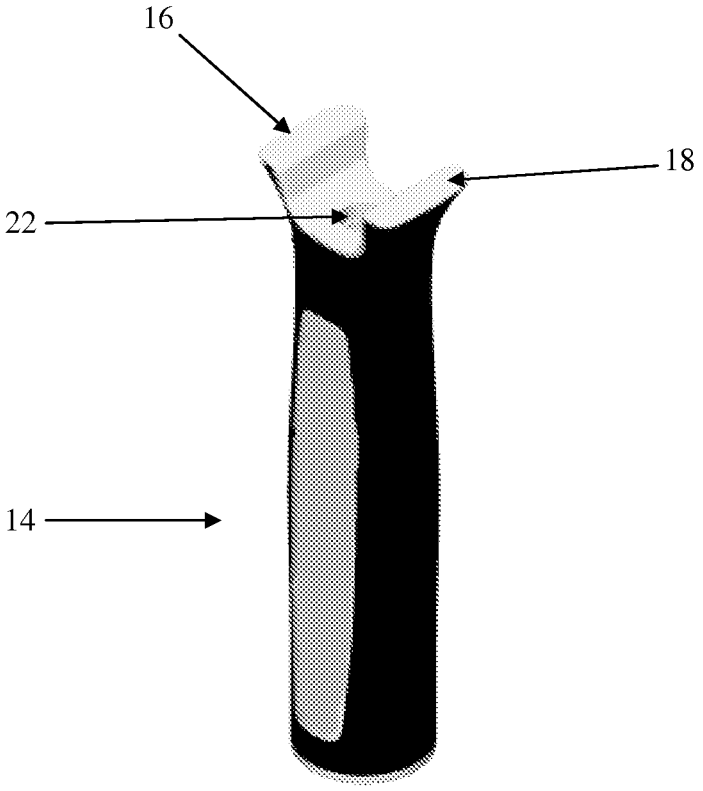

FIG. 26 is perspective view of an exemplary handle for a roller assembly.

Figure 27:
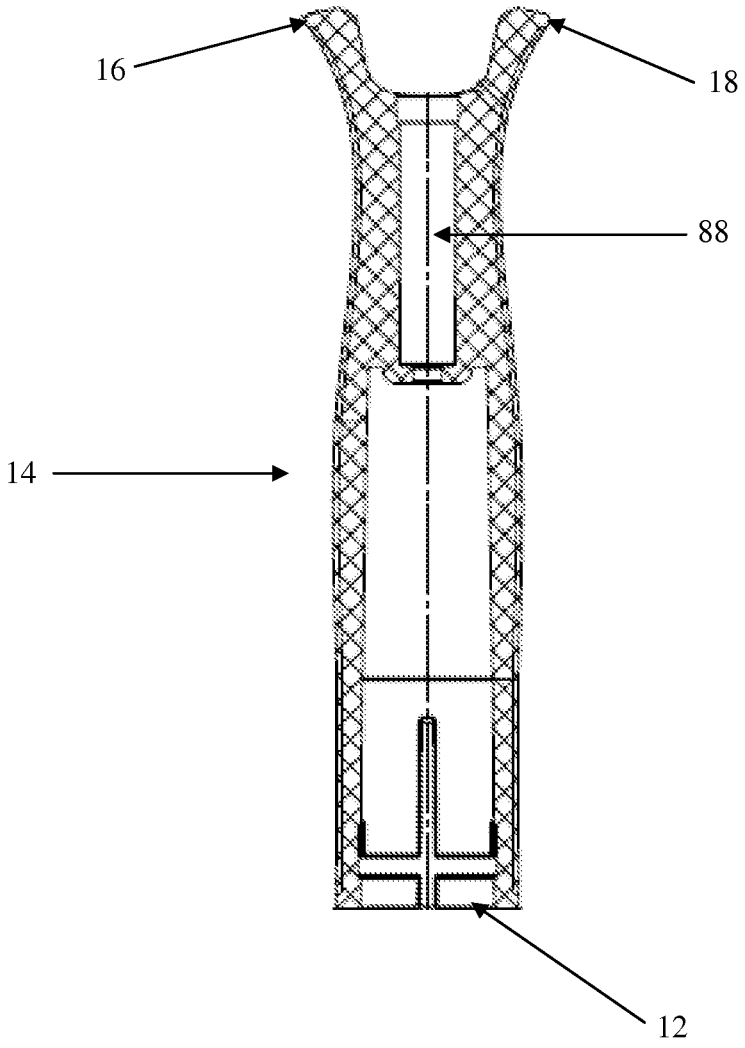

FIG. 27 is a cross-sectional view of the handle shown in FIG. 26.

Figure 28:
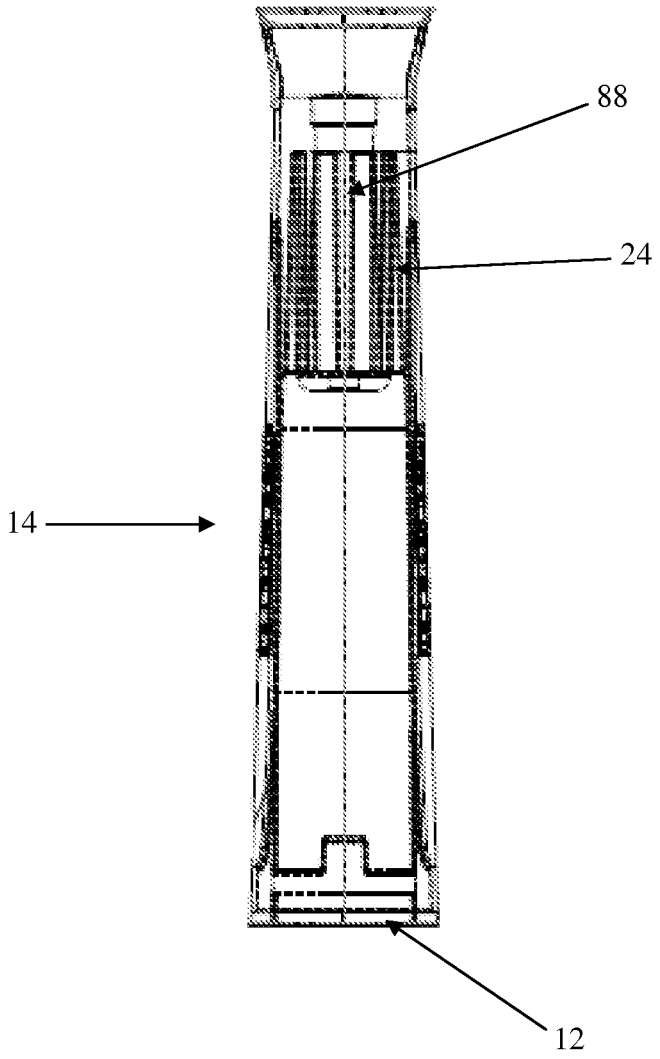

FIG. 28 is a cross-sectional view of the handle shown in FIG. 26.

Figure 29:
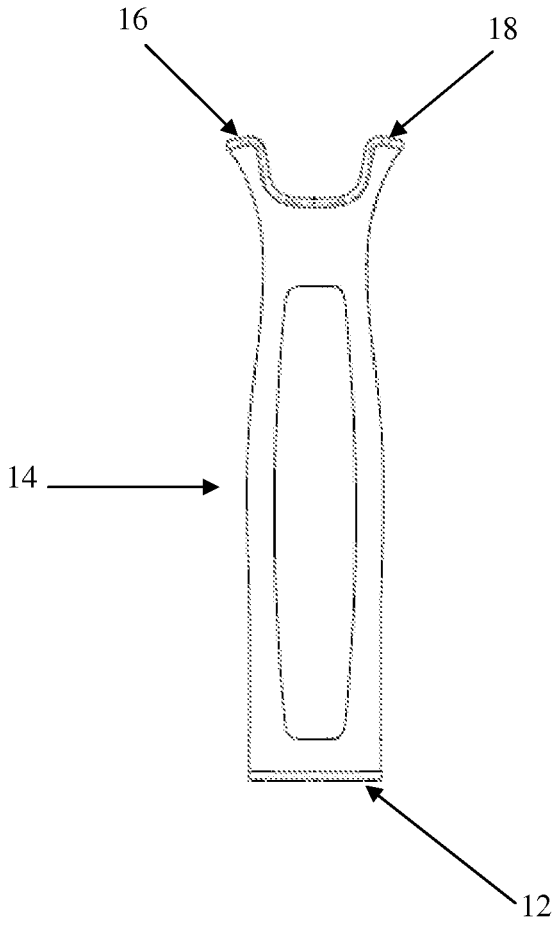

FIG. 29 is a front planar view of the handle shown in FIG. 26.

Figure 30:
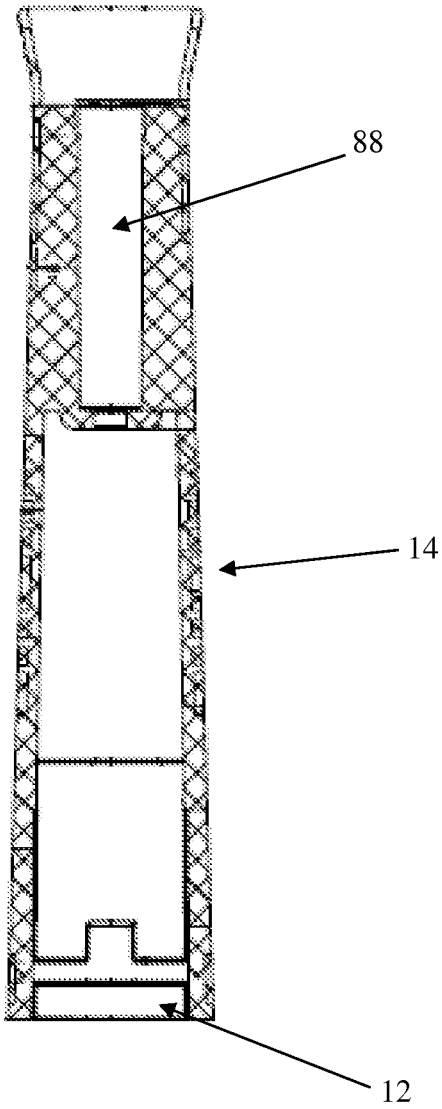

FIG. 30 is a cross-sectional view of the handle shown in FIG. 26.

Figure 31:
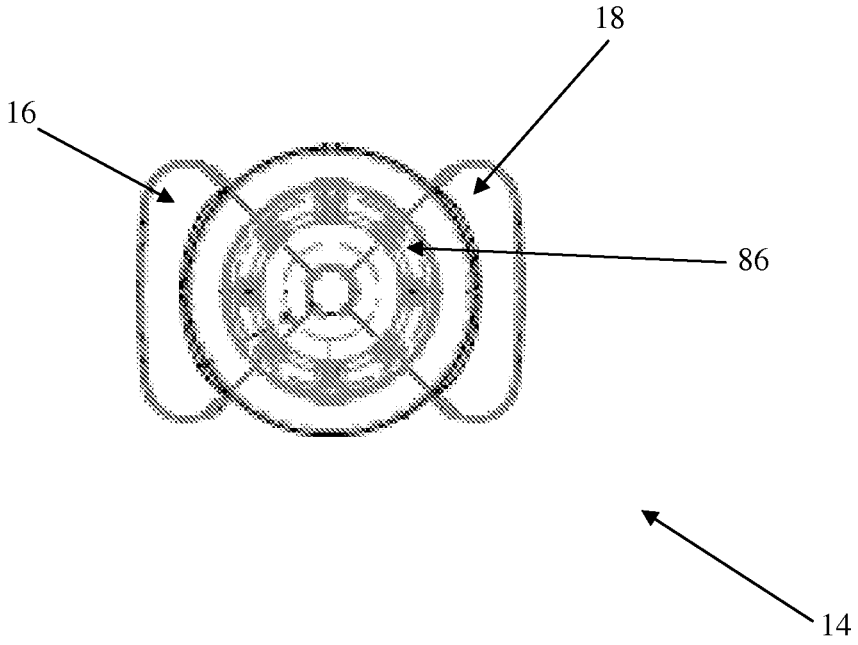

FIG. 31 is a bottom view of the handle shown in FIG. 26.

Figure 32:
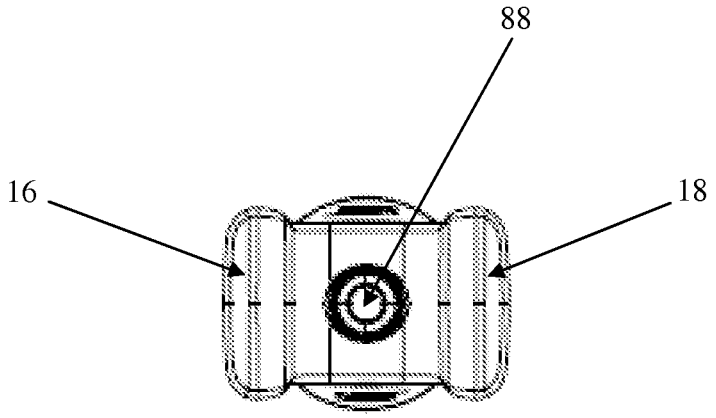

FIG. 32 is a top view of the handle shown in FIG. 26.

Figure 33:
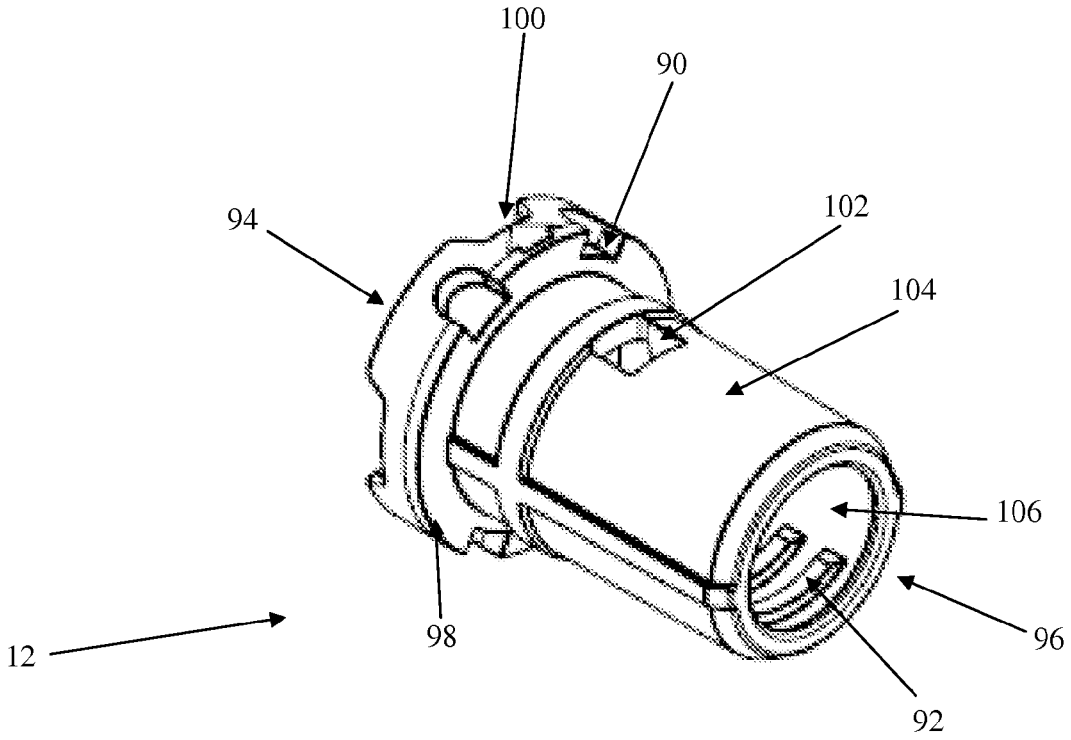

FIG. 33 is a perspective view of an exemplary insert which may be used to engage the bottom portion of the handle of a roller assembly.

Figure 34:
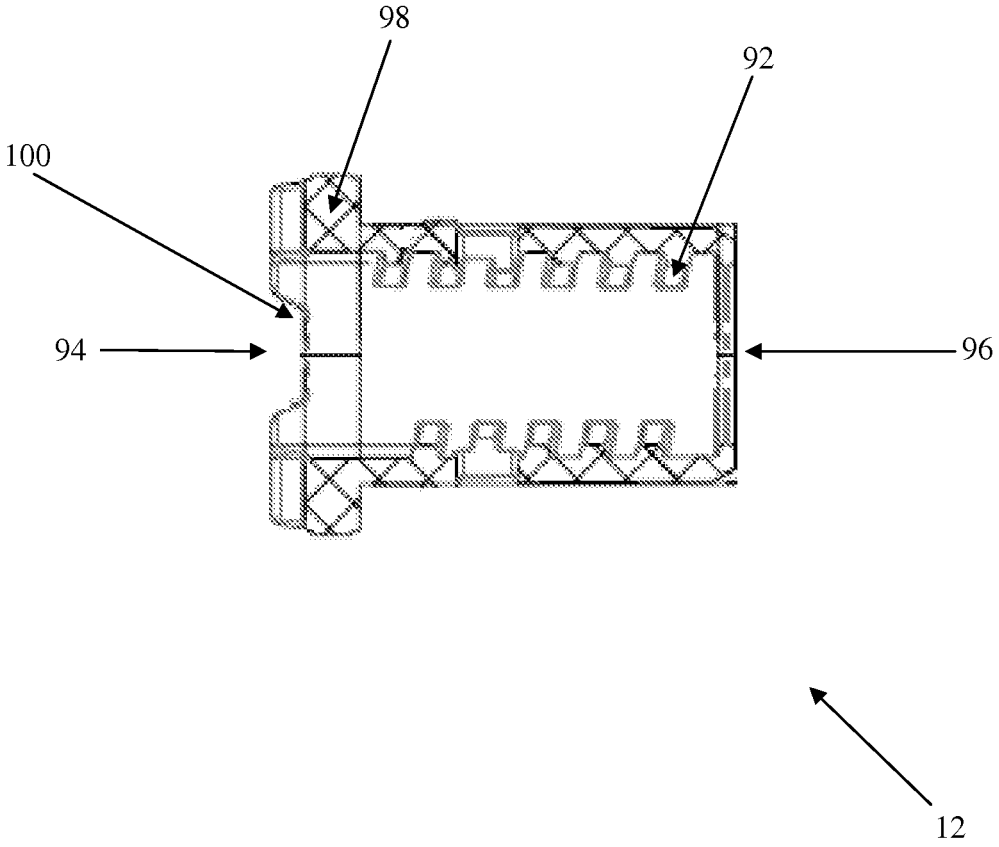

FIG. 34 is a cross-sectional view of the insert shown in FIG. 33.

Figure 35:
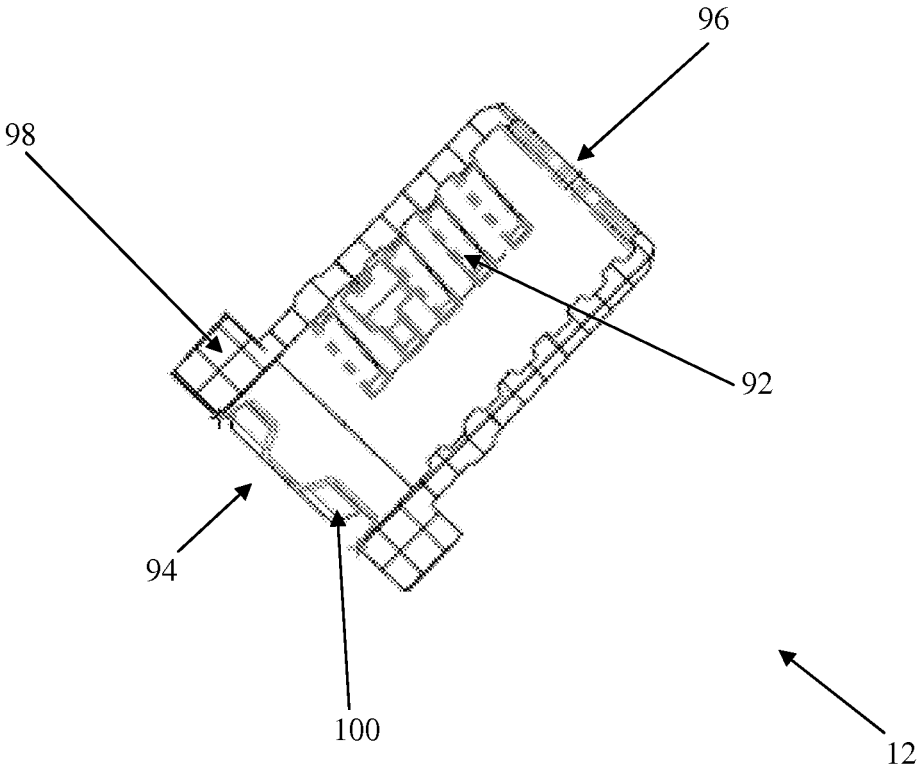

FIG. 35 is a cross-sectional view of the insert shown in FIG. 33.

Figure 36:
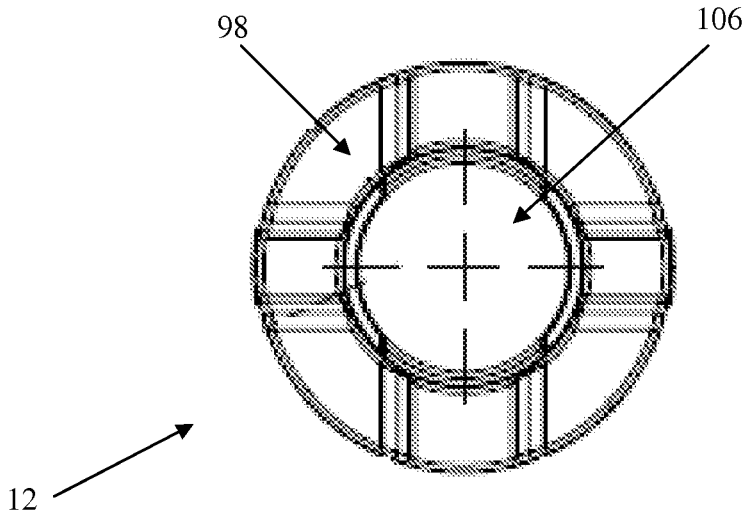

FIG. 36 is a bottom view of the insert shown in FIG. 33.

Figure 37:
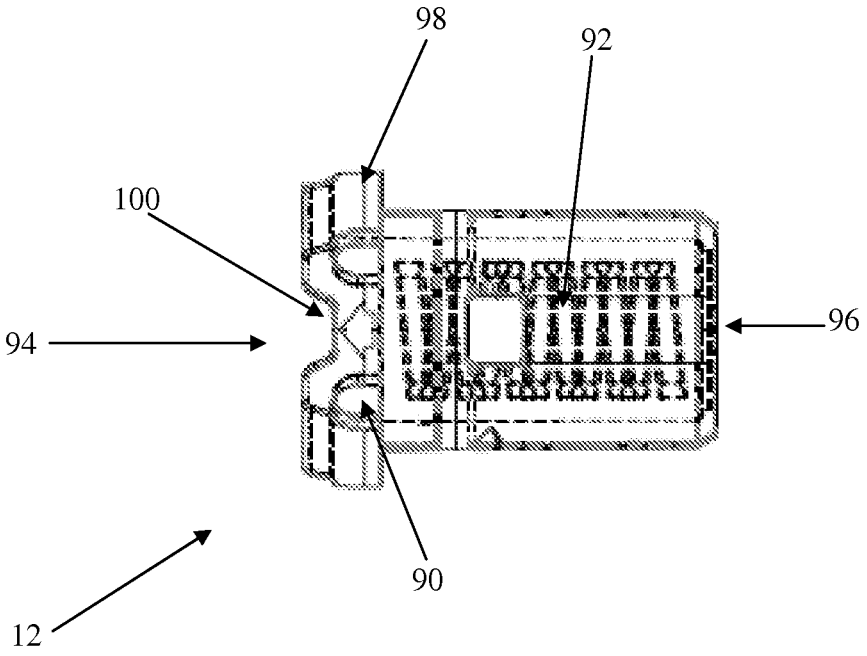

FIG. 37 is a cross-sectional view of the insert shown in FIG. 33.

Figure 38:
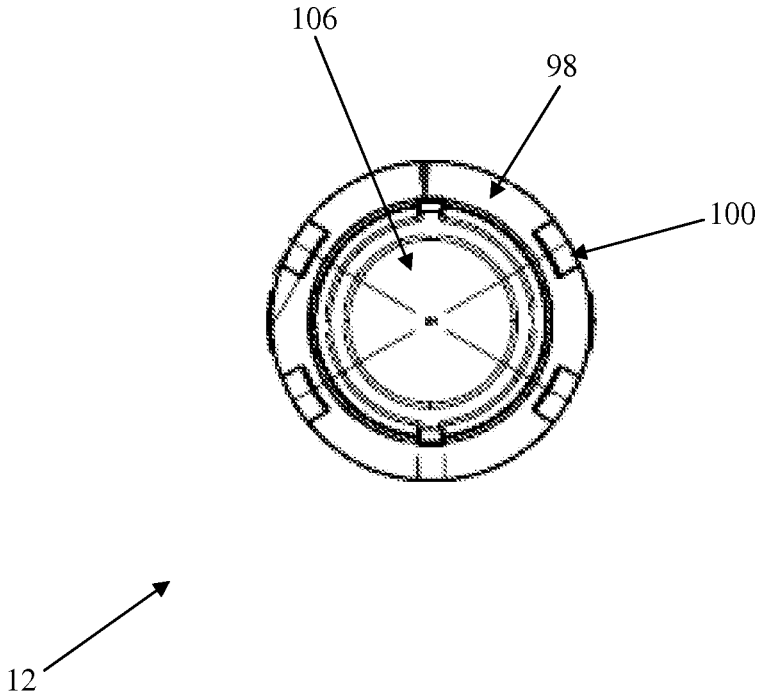

FIG. 38 is a top view of the insert shown in FIG. 33.

Figure 39:
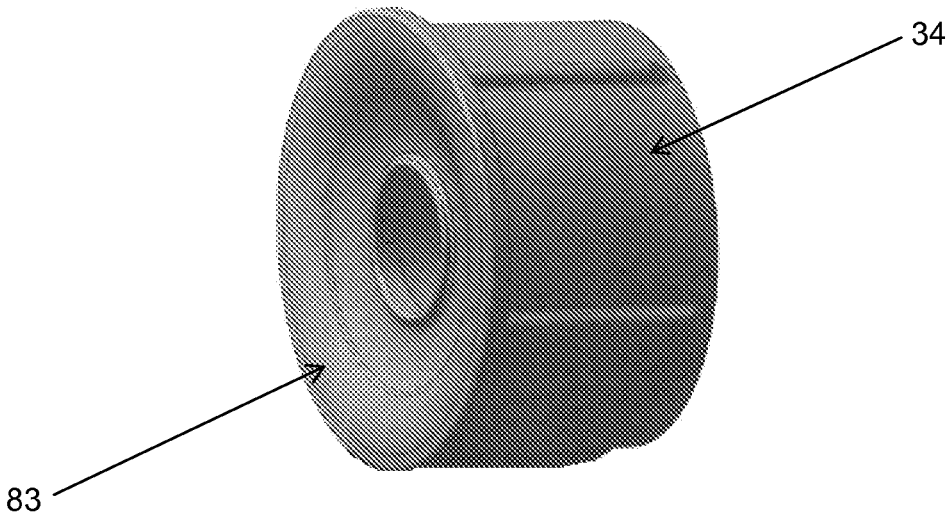

FIG. 39 is a perspective view of an exemplary bushing having a concave end cap.

Figure 40:
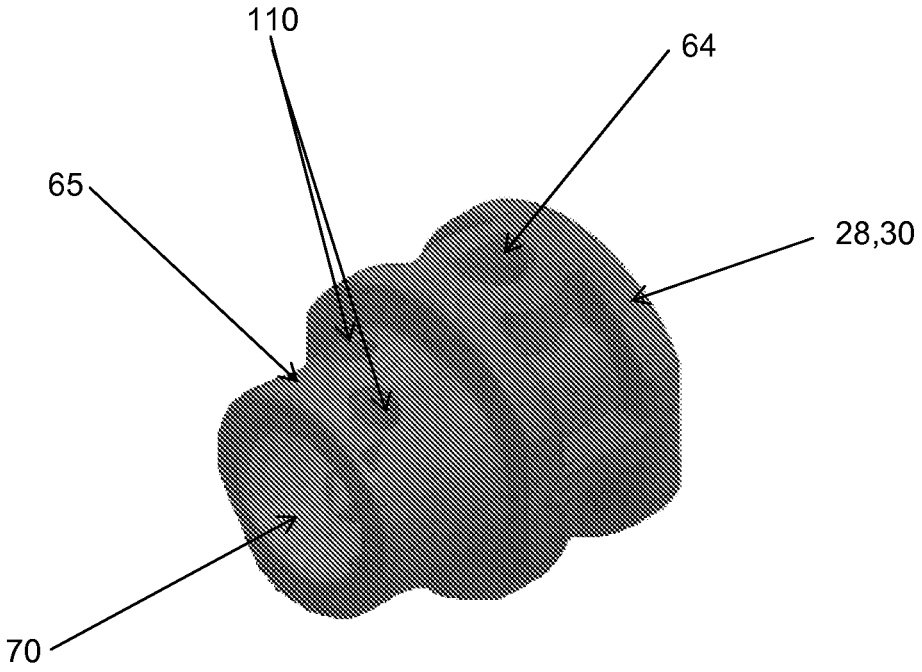

FIG. 40 is a perspective view of an exemplary bearing having slots or holes.

Figure 41:
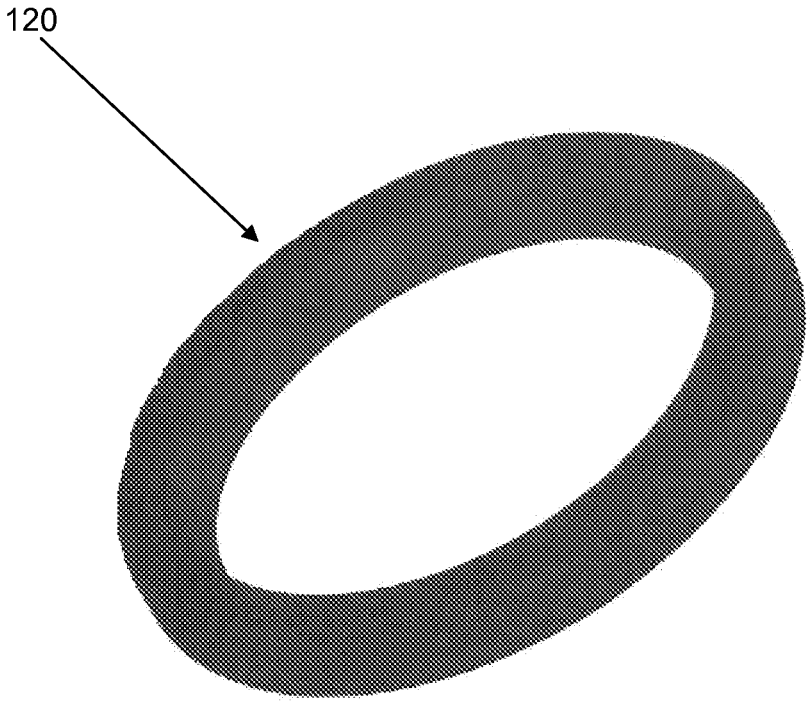

FIG. 41 is a perspective view of an exemplary seal fitted which may be fitted between a bearing and a bushing.

Figure 42:
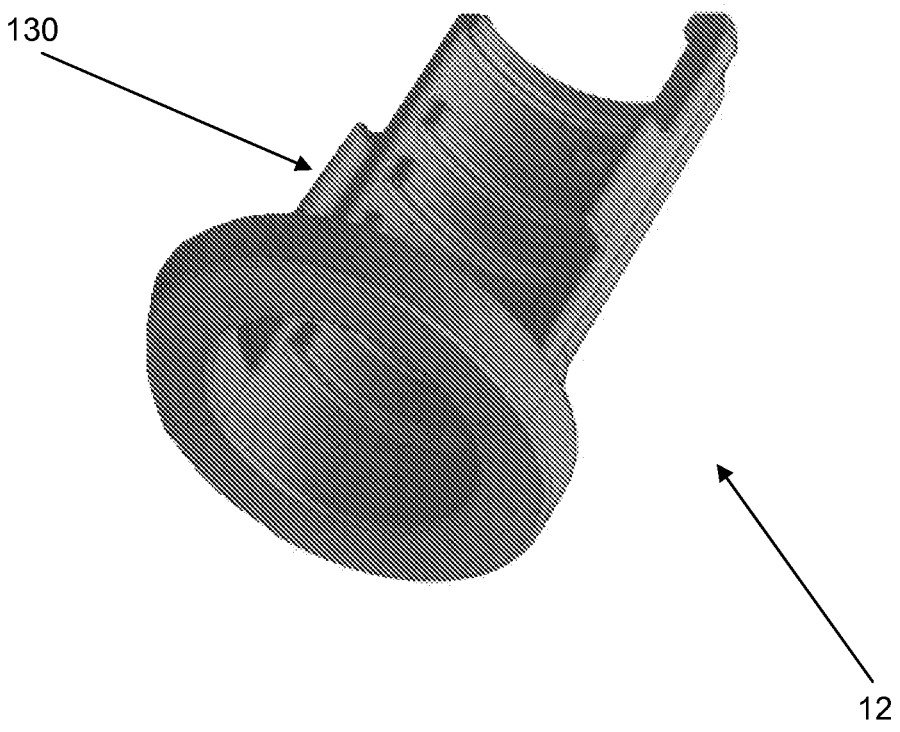

FIG. 42 is a perspective view of a first half of an insert which is divided into two halves.

Figure 43:
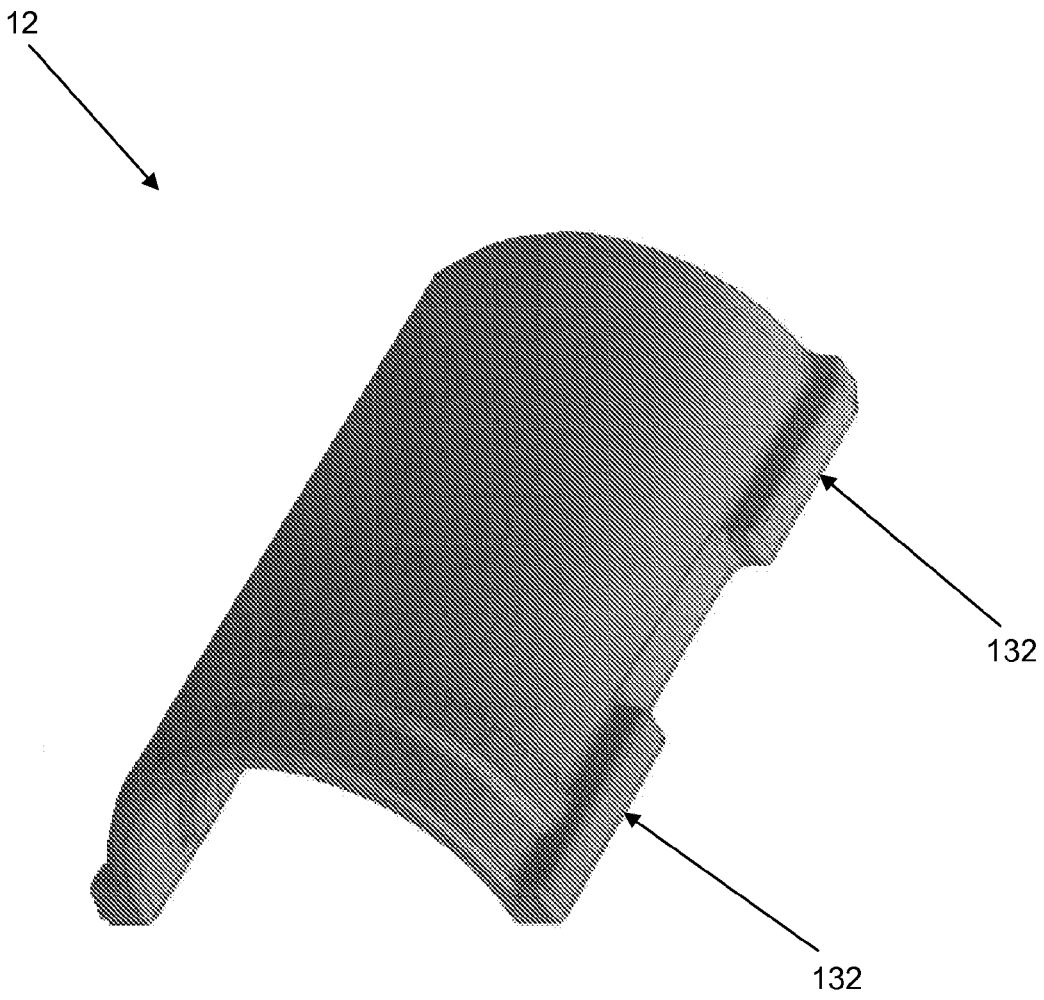

FIG. 43 is a perspective view of a second half of an insert which is divided into two halves.

Figure 44:
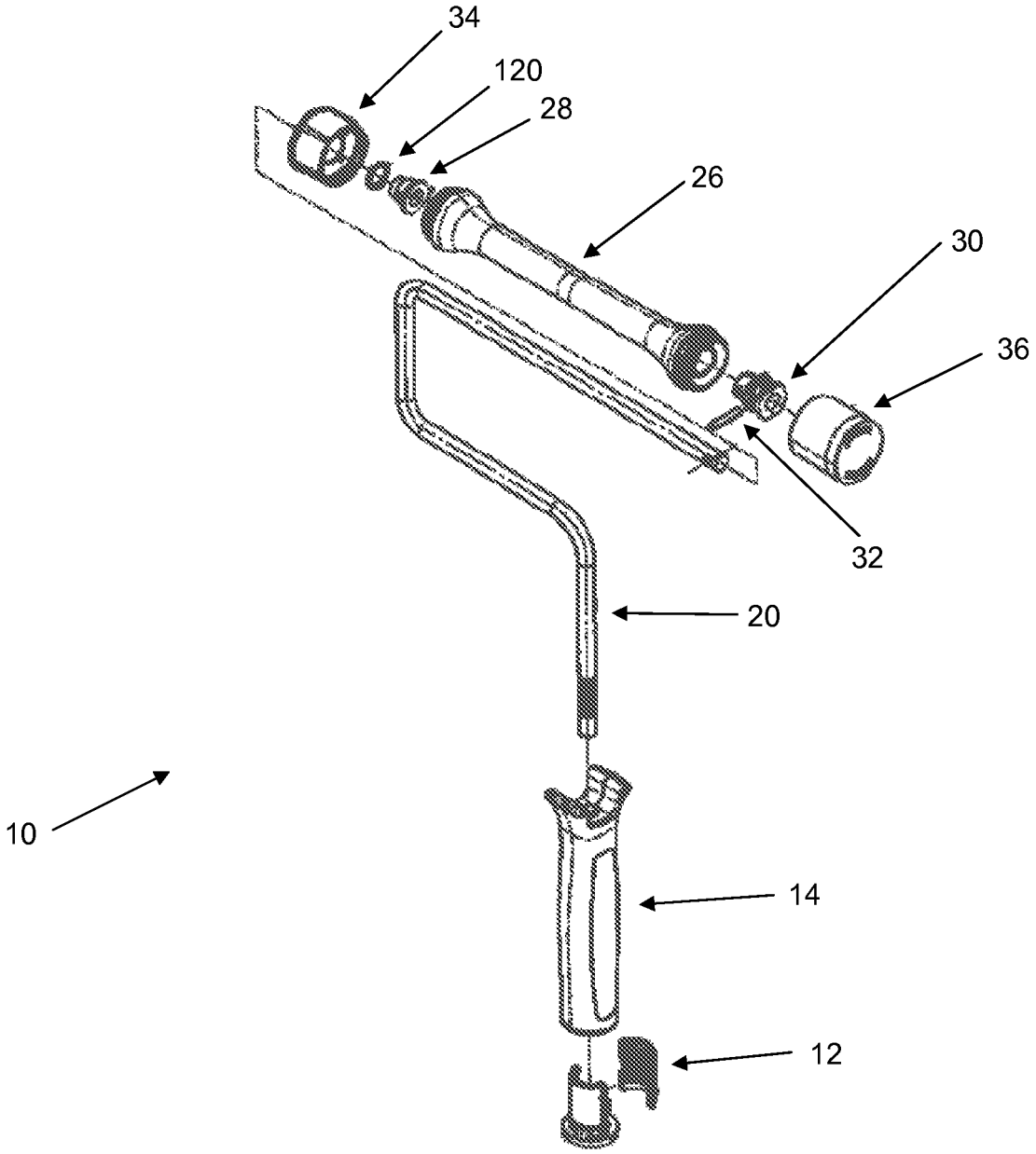

FIG. 44 is an exploded view of an assembly drawing of an exemplary roller assembly.

Figure 45:
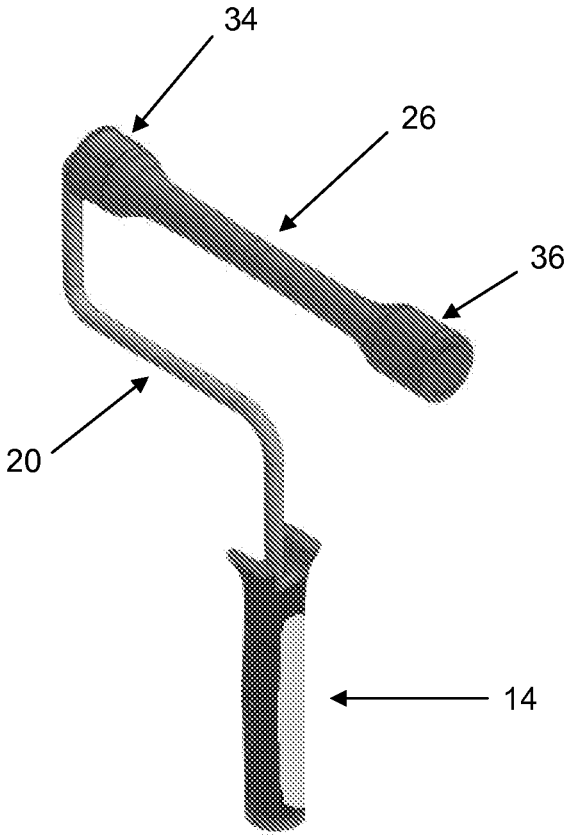

FIG. 45 is a perspective view of an exemplary roller assembly.

IV. DETAILED DESCRIPTION

Figure 1:
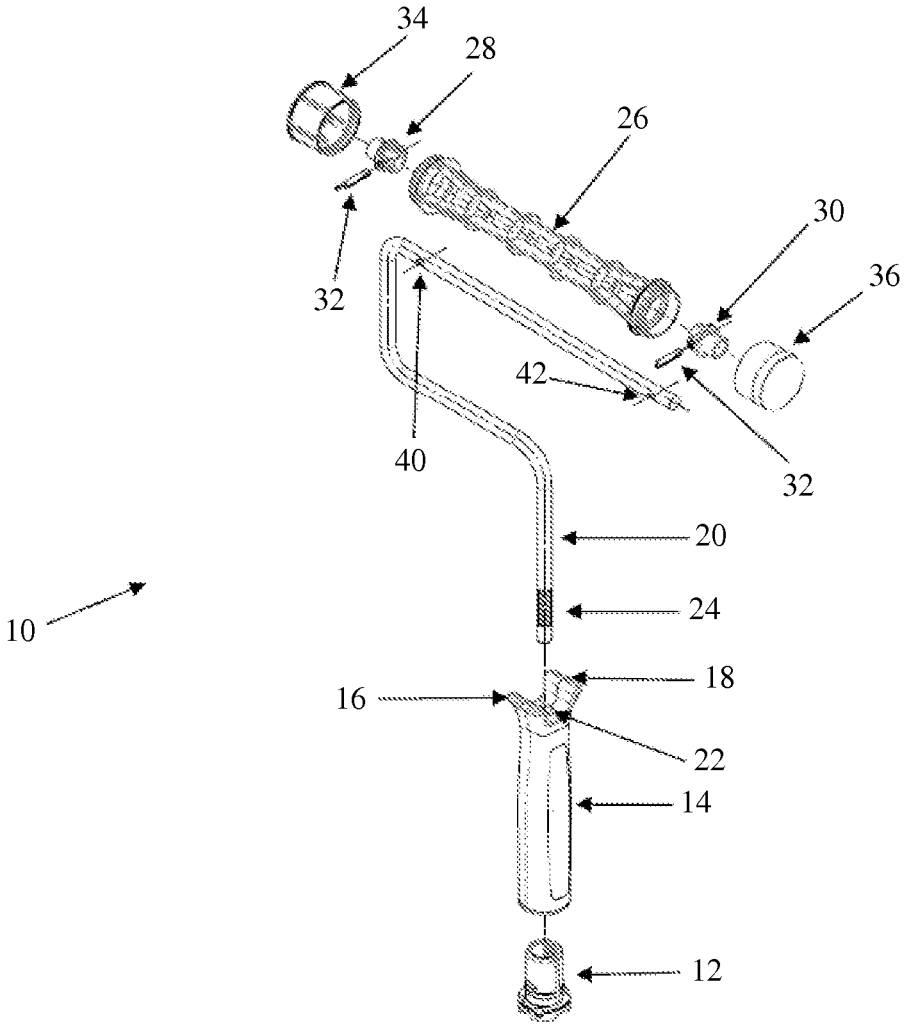
FIG. 1 is an exploded view of an assembly drawing of an exemplary roller assembly.

Referring now to the drawings wherein the showings are for purposes of illustrating embodiments of the roller assembly only and not for purposes of limiting the same, and wherein like reference numerals are understood to refer to like components. FIG. 1 shows an exemplary roller assembly (10) for application of paint or other like materials to a wall, ceiling, floor or other substrate. The roller assembly (10) includes a handle (14), a wire frame (20) and a roller (26) which is positioned over a portion of the wire frame (20) and axially rotatable relative to the wire frame (20).

With reference now to FIGS. 1-3 and 5-6, the wire frame (20) of the roller assembly (10) may have a first end and a second end. The first end of the wire assembly (10) may be designed to engage the handle (14) and the second end of the wire assembly (10) may be designed to engage the roller (26). In certain embodiments, the wire frame (20) may have a first and second vertical portion and a first and second horizontal portion. The first vertical portion of the wire frame (20) may be proximate to the first end of the wire frame (20) which engages the handle (14). The first vertical portion of the wire frame (20) may extend a desired length up to a first bend. This first bend of the first vertical portion of the wire frame (20) may define the first horizontal portion of the wire frame (20). The first horizontal portion of the wire frame (20) may extend a desire length up to a second bend. This second bend of the first horizontal portion of the wire frame (20) may define the second vertical portion of the wire frame (20). The second vertical portion of the wire frame (20) may extend a desired length up to a third bend. This third bend within the wire frame (20) may define the second horizontal portion of the wire frame (20). In certain embodiments, a roller (26) is positioned over the second horizontal portion of the wire frame (20) and axially rotatable relative to the second horizontal portion of the wire frame (20). The roller (26) may, in certain embodiments, be a cylindrical piece having a cylindrically consistent smooth surface or in alternative embodiments, be a cage (26). The wire frame (20) and roller (26) may be manufactured from any materials within the sound judgment of those of skill in the art. In certain embodiments, the wire frame (20) is manufactured from aluminum and the roller (26) is manufactured from a plastic (e.g., a thermoplastic).

Figure 5:
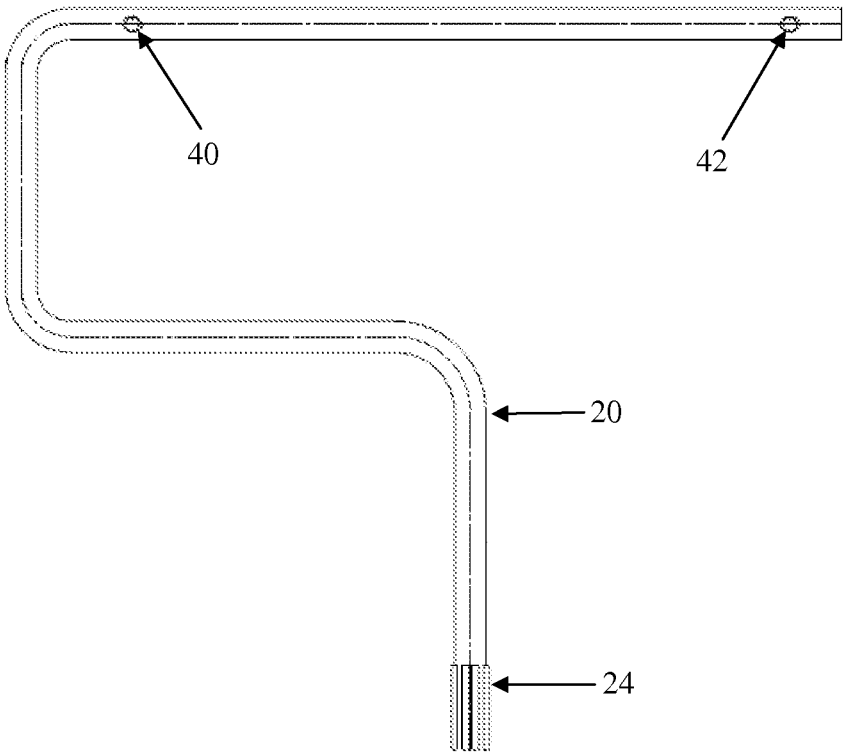
FIG. 5 is a front planar view of an exemplary wire for the frame of a roller assembly.

As mentioned above, the first end of the wire frame (20) may be designed to engage a handle (14). Any means for interlocking the wire frame (20) to the handle (14) within the sound judgment of those of skill in the art may be used. In certain embodiments, the handle (14) includes an aperture (22) at a first end or top portion defining a chamber (88) which is designed to receive the first vertical portion at the first end of the wire frame (20). The first vertical portion at the first end of the wire frame (20) may, in certain embodiments, include a handle engagement portion (24) which is designed to secure the wire frame (20) to the handle (14) as the wire frame (20) is inserted into the aperture (22). With reference to FIG. 5, the handle engagement portion (24) may in certain embodiments, be a sleeve which encircles the circumference of the wire frame (20). The sleeve may be attached to the wire frame (20) by any means and may be manufactured from any materials within the sound judgment of those of skill in the art. In certain embodiments, an interlocking ball pin (44) may be embedded within the first end of the wire frame (20) by a swedge (45) to engage the sleeve. This sleeve may, in certain embodiments, include ribs designed to engage corresponding ribs (86) positioned within the chamber (88) of the handle (14). Alternatively, the handle engagement portion (24) may possess ridges pressed directly onto the wire frame (20). In an alternative embodiment, the handle engagement portion (24) may include external threads which are designed to engage internal receiving threads located within the cavity at the first end of the handle (14). In other embodiments, the first end of the wire frame (20) may be adhesively secured to the first end of the handle (14). In further embodiments, the first end of the wire frame (20) may be press fitted into the aperture (22) at first end of the handle (14). The handle (14) may be manufactured from any materials within the sound judgment of those of skill in the art. In certain embodiments, the handle (14) is formed from a plastic (e.g., a thermoplastic).

In certain embodiments, the handle (14) may also include a first projecting edge (16) and a second projecting edge (18) both of which may be positioned at the first end of the handle (14). The first and second projecting edge (16) and (18) may, in certain embodiments, function to position and hold the roller assembly (10) along the edge of a tray when the roller assembly (10) is not being used.

In certain embodiments, the second end or bottom portion of the handle (14) is designed to engage an insert (12). Any means within the sound judgment of a person of skill in the art may be utilized to secure the insert (12) to the second end of the handle (14). For example, the insert (12) may be threadably or adhesively engaged to the handle (14). The insert (12) may also be press fitted onto the handle (14). In other embodiments, the insert (12) may be fitted onto the handle (14) through an interlocking pin. In certain embodiments, the insert (12) may include an insert body (104) having an interior chamber (106), a first or bottom end (94) and a second or top end (96). The insert body (104) may be a barrel. In certain embodiments, the second or top end (96) of the insert (12) is fitted into the handle (14). In certain embodiments, the insert (12) functions as an adapter designed to engage an extension pole system for the roller assembly (10). In certain embodiments, the insert (12) is designed to engage an adjustment mechanism for an extension pole system.

With reference now to FIGS. 33-38, the insert (12) may include at least one insert hole (102) which is designed to receive an actuator pin (not shown) of an extension pole system through the interior chamber (106) of a first end (94) of the insert (12). The insert (12) may also include an insert flange (98) and concave features (100) which are designed to prevent relative rotation of an extension pole system with the insert (12) when such extension pole system is engaged to the first end of the insert (12). The interior chamber (106) of the insert (12) may also include two areas of multiple insert ribs (92) (only one area shown) that extend axially on the top and bottom of the interior of the insert (12) and two areas of smooth surfaces (no ribs) that extend axially on the interior sides of the insert (12). The multiple insert ribs (92) may be designed to engage an extension pole system or an adjustment mechanism for an extension pole system. In certain embodiments, the insert (12) may also include multiple U-shaped recesses (90) defined within the edge of the insert flange (98). When insert (12) is engaged to the handle (14), these U-shaped recesses (90) form an aperture which is capable of engaging a locking pin of an extension pole system or an adjustment mechanism for an extension pole system in order to secure the extension pole system to the handle (14) of the roller assembly (10). The insert (12) may be manufactured from any materials within the sound judgment of those of skill in the art. In certain embodiments, the insert (12) is manufactured from a plastic (e.g., a thermoplastic such as nylon).

With reference to FIGS. 42 through 44, the insert (12), in certain embodiments, may consist of first and second half portions. In such embodiments, the first half portion of the insert (12) may include a protrusion (130) which fittingly engages between two elevated portions (132) on the second half portion of the insert (12).

The assembly of the roller assembly 10 will now be described. As mentioned above and as shown in FIGS. 1-3 and 44, the roller or cage (26) is positioned over a second horizontal portion at the second end of the wire frame (20). The roller or cage (26) may engage the second end of the wire frame (20) through any means within the sound judgment of a person of skill in the art. However, in certain embodiments, the roller or cage (26) engages the second end of the wire frame (20) through the use of bearings and bushings which are attached to the wire frame (20) and the roller or cage (26). In certain embodiments, a first bearing (28) and a second bearing (30) may be attached to opposing ends of the second horizontal portion at the second end of the wire frame (20) as shown in FIGS. 1 and 3. With reference to FIGS. 12-13, the bearings may include a first end (66) and a second end (68) and an aperture defining a first internal chamber (64) through which a pin (32) may pass through. The first bearing (28) and the second bearing (30) may also contain a second internal chamber (70) which is perpendicular to the first internal chamber (64). The second end of the wire frame (20) engages the first bearing (28) and the second bearing (30) through the second internal chamber (70) of the respective bearings. The first bearing (28) and second bearing (30) are slid to the appropriate positions on the second horizontal surface at the second end of the wire frame (20). The second horizontal portion at the second end of the wire frame (20) includes a first aperture (40) and a second aperture (42) through which a pin (32) may pass through. Accordingly, the first bearing (28) and the second bearing (30) may be engaged to the wire frame (20) in the following manner. First, the second end of the wire frame (20) may be inserted into the second internal chamber (70) of the second end (68) of the first bearing (28) and the second internal chamber (70) of the first end (66) of the second bearing (30). The first bearing (28) and second bearing (30) may then be slid to their respective predetermined positions along the second horizontal portion at the second end of the wire frame (20) where first aperture (40) and second aperture (42) are located. A pin (32) may then be inserted into the first internal chamber (64) of the first bearing (28) and a pin (32) may then be inserted into the first internal chamber (64) of the second bearing (30). As the respective pins (32) pass through the first internal chamber (64) of the first bearing (28) and first internal chamber (64) of the second bearing (30), it will also pass through apertures (40) and (42) on the wire frame (20) which are respectively aligned with the first internal chamber (64) of the first bearing (28) and the second bearing (30). The first bearing (28) and the second bearing (30) may also include a shoulder portion (62) which will be described in further detail below. The pin (32) and bearings (28) and (30) may be manufactured from any materials within the sound judgment of those of skill in the art. In certain embodiments, the pin (32) is manufactured from a metal (e.g., stainless steel) and the bearings are manufactured from a plastic (e.g., a thermoplastic).

The use of the above-described pinned structure to engage the first bearing (28) and the second bearing (30) to the wire frame (20) may be referred to as a "double-pin" structure. This "double-pin" structure negates the use of swedges and washers to hold the roller or cage (26) in place on the wire frame. This also allows the length of the second horizontal portion wire frame (20) to be reduced as less area is needed to accommodate a swedge, washer or other types of fasteners resulting in a wire frame (20) having a shorter width. Roller assemblies having wire frames of shorter width may be advantageous to insert into smaller sized containers or containers having tapered ends. Furthermore, elimination of swedge and washer fasteners prevents accumulation of dried paint along the edges of the wire frame. Such dried paint may fall into wet paint that is to be applied to a surface and ultimately result in a deformation in the applied paint coating and unsightly appearance. The "double-pin" structure described above also provides for a more durable roller frame assembly which exhibits better rolling action through the roller or cage. It is further contemplated that in alternative embodiments, the first and second bearings (28) and (30) may include additional apertures so that more than one pin may be inserted through the bearing and a corresponding aperture on the wire frame (20).

The roller or cage (26) itself has a first end and a second end. In certain embodiments, the roller or cage (26) may further include a first bushing (34) engaged to the first end of the roller or cage (26) and a second bushing (36) engaged to the second end of the roller or cage (26) as shown in FIGS. 1, 2, 4 and 44. Exemplary embodiments of the first bushing (34) will now be described in further detail with reference to FIGS. 19-22. The first bushing (34) may, in certain embodiments, have a substantially cylindrical body (73) having an outer wall and an inner wall defining an internal chamber (75), a first end (closed end) and a second end (open end). In certain embodiments, the internal chamber (75) of the first bushing (34) may include spokes (78) which extend from a centrally positioned hub (80) within the first bushing (34). The hub (80) itself may be substantially cylindrical piece having a solid or a hollow interior portion. In certain embodiments, the hub (80) includes a substantially cylindrical outer frame and a hollow interior portion. In further embodiments, the spokes (78) may laterally extend past the outer frame of the substantially cylindrical hub (80) towards the second end (open end) of the first bushing. In further embodiments, the lateral extension of the spokes (78) is tapered between the inner wall (77) and the edge of the outer frame of the substantially cylindrical hub (80). Together, the substantially cylindrical hub (80) and the spokes (78) which include a lateral and tapered extension past the outer frame of the hub (80) inner wall (77) and the edge of the outer frame of the hub (80) forms a cradle which can rest upon the first end of the first bearing (28). More specifically, the second end (68) of the first bearing (28) includes a cylinder (65) which may be inserted or positioned within the internal hollow portion of the cylindrical hub (80). This arrangement also allows the shoulder (62) on the first bearing (28) to contact the edge of the outer frame of the substantially cylindrical hub (80). The first bushing (34), when engaged to the first end of the roller or cage (26) secures the first end of the roller or cage (26) to the second horizontal portion of the wire frame (20), and prevents the roller or cage (26) from sliding towards the second end of the wire frame (20) and falling off of the roller assembly (10).

The first bushing (34) may be engaged to the first end of the roller or cage (26) through any means within the sound judgment of those of skill in the art. For example, the first bushing (34) may be threadably or adhesively engaged to the first end of the roller or cage (26) With reference to FIGS. 21 and 22, the first bushing (34) is engaged to the first end of the roller or cage (26) through a snap configuration between the first bushing (34) and the first end of the roller or cage (26). The snap configuration may be achieved by an internal protrusion (79) along the inner surface of the inner wall (77) of the first bushing (34) and a recess (60) positioned at the first end of the roller or cage (26) as shown in FIG. 11. In certain embodiments, this internal protrusion (79) extends along the inner circumference of the interior wall (77) of the first bushing and the recess (60) extends along the outer circumference at a cylindrical portion of the first end of the roller or cage (26).

With reference to FIGS. 41 and 44, in certain embodiments, a seal (120) may be placed between the first bearing (28) and the first bushing (34). In certain embodiments the seal (120) may be placed over the cylinder (65) of the first bearing (28). This seal may be utilized to prevent water, paint or other liquids from entering the internal space between the bearing and the bushing and may also prevent water, paint or other liquids which has entered the space between the bearing and the bushing from exiting that space and dripping into the wet paint that is to be applied to a surface (also known as paint migration). In alternative embodiments, a seal (120) may also be placed between the second bearing (30) and the second bushing (36).

With reference to FIGS. 19, 21 and 22, the cylindrical body (73) of the first bushing (34) includes a first end (87) and a second end (89). The cylindrical body (73) of the first bushing (34) may include multiple external ribs (72) spaced at various points along the outer surface of the cylindrical body (73). In certain embodiments, the first end (87) of the first bushing (34) may include an end cap (83) positioned over the cylindrical body (73). The end cap (83) may include a center-positioned, substantially circular aperture through which the second end of the wire frame (20) may pass through. By utilizing a pinned-bearing in combination with a first bushing to engage the roller or cage (26) to the wire frame (20), a more secure or tighter fit of the roller or cage (26) to the wire frame (20) may be achieved. This fit can be observed within the circular aperture of end cap (83) which allows for less movement or play between roller or cage (16) and the wire frame (20). This feature may be desirable to prevent paint from accumulating within the aperture within the end cap (83) of the first bushing (34) as such paint can dry and fall into wet paint that is to be applied to a surface resulting in deformations in the applied paint coating and an unsightly appearance. Such dried paint may also inhibit the rolling action of the roller or cage (26) as the roller assembly (10) is being used.

In further embodiments, the end cap (83) is concave in that it curves inward toward the interior of the first bushing (34). FIG. 39 illustrates an exemplary embodiment of such and end cap having a concave surface. The feature of a concave end cap (83) can allow for a shorter second horizontal portion of the wire frame (20) which results in a wire frame (20) having a shorter width. Such smaller sized wire frames may allow the roller assembly (10) to be inserted into smaller sized containers. The feature of a concave end cap (83) may also reduce the surface area of the end cap (83) which can contact the edge of a container which can result in scraping of dried paint into the wet paint that is to be applied to a surface. Such dried paint can result in deformations within the applied paint coating and can result in an unsightly appearance. Accordingly, a concave end cap can result in less scraping of dried paint and accumulation of dried paint within the wet paint that is to be applied and ultimately the applied paint coating.

In yet further embodiments, the end cap (83) may possess a diameter which is greater than the diameter of the cylindrical body (73) so that the end cap (83) forms a substantially circular rim (85) over the cylindrical body (73). In further embodiments, the multiple external ribs (72) on the cylindrical body (73) of the first bushing (34) may extend short of the end cap (83) forming a gap (81) between the circular rim (85) and the external ribs (72). In certain embodiments, the end of external ribs (72) adjacent to the circular rim (85) may have an angular or trapezoidal shape. The gap (81) may function to secure a paint roller cover over the roller or cage (26) of the roller assembly (10). This may be accomplished by inserting a polypropylene roller cover over the roller or cage (26) of the roller assembly (10) so that one end of the roller cover fits over the gap (81) and the external ribs (72) of the first bushing (34). In such embodiments, the interior of the roller cover may be manufactured from a viscoelastic material having a memory (e.g., a polypropylene). When inserted over the external ribs (72) and gap (81) of the first bushing (34), the portion of the interior surface of the roller cover in contact with the external ribs (72) may depress relative to the portion of the interior surface of the roller cover which covers the gap (81) (not in contact with the external ribs (72)). The portion of the roller cover which covers the gap (81) may shrink back or become undepressed to contact the surface of the cylindrical body (73) within the gap (81) of the first bushing (34). This allows the gap (81) to function as a lock which secures the roller cover onto the roller or cage (26) when abutted by depressed interior portions of the roller cover which are positioned over the external ribs (72), thereby preventing the roller cover from walking off of the roller assembly (10) as it is being used. In certain embodiments, the outer surface of the cylindrical body (73) of the first bushing (34) may include at least five external ribs while in other embodiments, the outer surface of the cylindrical body (73) of the first bushing (34) may include at least six external ribs. In further embodiments, the gap between the circular rim and the external ribs on the cylindrical body of the first bushing may range from about 2.2 to about 2.5 millimeters.

As described above and with reference to FIGS. 8-10, the roller or cage (26) includes a first end (52) and a second end (54). The roller or cage (26) may further be described as a cylindrical-like structure which is positioned over the second end of the wire frame (20), which is axially rotatable relative to the wire frame (20) and which is capable of holding a paint roller cover. In certain embodiments, the cylindrical-like structure of the cage (26) may be formed by lateral elements (56) and circular elements (58) which are positioned perpendicular to each other. In certain embodiments, the lateral elements (56) and circular elements (58) may be formed from a single mold. The cylindrical-like structure of the cage (26) may, in certain embodiments, include at least two lateral elements (56) and at least two circular elements (58) positioned respectively at the first end (52) and second end (54) of the cage. In further embodiments, the cylindrical-like structure of the cage (26) may include three lateral elements (56) and three circular elements (58), two of which are positioned respectively at the first end (52) and second end (54) of the cage and one of which is positioned at a point along the interior of the cage (26). In yet further embodiments, the cylindrical-like structure of the cage (26) may include four lateral elements (56) and six circular elements (58), two of which are positioned respectively at the first end (52) and second end (54) of the cage and four of which are positioned at various points along the interior of the cage (26). The lateral elements (56) may, in certain embodiments, be spaced at equidistant points relative to each other along the cage. Likewise, the circular elements (58) may, in certain embodiments, be spaced at equidistant points relative to each other along the cage (26).

In certain embodiments, the roller or cage (26) may include a first substantially circular rim (53) extending from circular element (57) at its first end (52) and a second substantially circular rim (55) extending from circular element (59) at its second end (54). The diameter of the first and second rims (53) and (55) may be sufficiently sized to respectively engage the first and second bushing (34) and (36). In certain embodiments the diameter of the first and second rims (53) and (55) is less than the diameter of the circular element (57) and (59). In certain embodiments, the first and second rims may include a recess (60) along the circumference of the rim which allows for the first end (52) and second end (54) of the roller or cage (26) to respectively engage an internal protrusion (79) along the inner surface of the inner wall (77) of the first bushing (34) and second bushing (36).

In further embodiments, the diameter of a portion of the first end (52) and second end (54) of the roller or cage (26) may be increased relative to the diameter of the internal portions of the roller or cage (26). This increased diameter at the first end (52) and second end (54) of the roller or cage (26) may be achieved by utilizing a first circular element (57) and a second circular element (59) having an increased diameter relative to the circular elements positioned internally along the body of the roller or cage (26) and by tapering the respective lateral elements at the first and second end of the cage (52) and (54) outwardly to connect to first and second circular elements (57) and (59). In embodiments where the roller (26) is manufactured in the shape of a cylindrical piece having a cylindrically consistent smooth surface, the roller may have a radially expanded portion at its first end (52) and second end (54) relative to its interior portion. This type of roller may be described as having a "dog bone" shape and is illustrated within FIGS. 44 and 45. Accordingly, this "dog bone" roller may be a continuous piece consisting of three distinct sections (two radially expanded sections at the first and second ends (52) and 54) and an interior portion) which may be symmetric about the dog bone member's longitudinal axis.

The roller or cage (26) may be referred to as a core support assembly. The core support assembly may be sized to receive a paint roller cover. The paint roller cover (not shown), may be forcibly slid over the core support assembly. The outside surfaces of the core support assembly may grip the inside diameter of the roller cover. The resulting grip may be tight enough to prevent the cover from working its way off the core support assembly during use but also light enough so that the roller cover may be easily installed or removed for cleaning or disposal without the use of tools. Accordingly, the radially expanded portions of the first end (52) and second end (54) of the cylindrically consistent roller or cage (26) may function to secure a paint roller cover over the roller or cage (26) of the roller assembly (10). In such cases, the radially expanded portions of the first end (52) and second end (54) of the cylindrically consistent roller or cage (26) causes the inner surface at the first and second end of a roller cover to depress relative to the inner surface within the interior of the roller cover.

Figure 2:
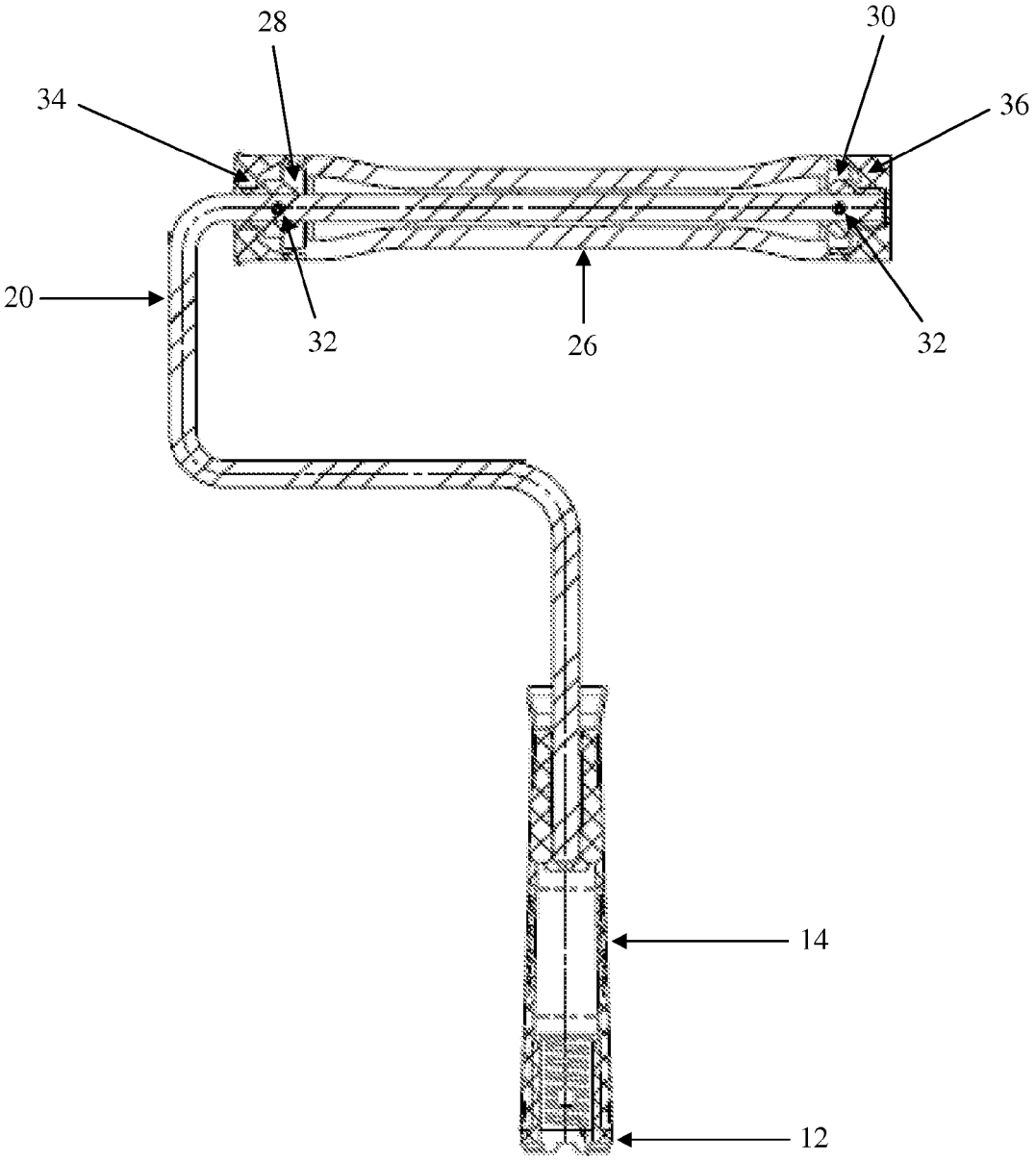
FIG. 2 is a cross-sectional view of an exemplary roller assembly.
Figure 3:
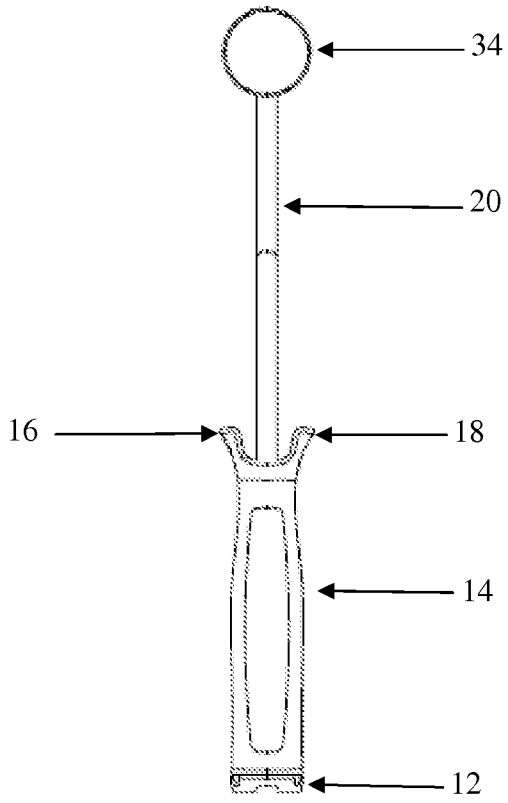
FIG. 3 is an outboard view of the roller assembly shown in FIG. 2.
Figure 4:
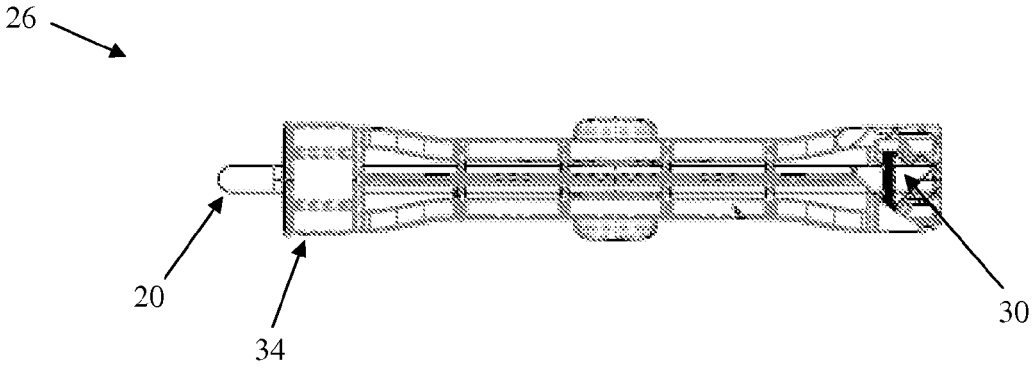
FIG. 4 is a top view view of a roller portion of the roller assembly shown in FIG. 2.

With reference to FIGS. 1, 2, 4 the second end (54) of the roller or cage (26) may be engaged to the wire frame (20) through a second bearing (30), a second bushing (36) engaged to second bearing (30) at the second end (54) of the roller or cage (26) as shown in FIGS. 1, 2 and 4. Exemplary embodiments of the second bushing (36) will now be described in further detail with reference to FIGS. 23-25. The second busing includes a first end (99) and a second end (101). The second bushing (36) may, in certain embodiments, have a substantially cylindrical body (93) having an outer wall and an inner wall defining an internal chamber (75), a first end (closed end) and a second end (open end). In certain embodiments, the internal chamber (95) of the second bushing (36) may include spokes (82) which extend from a centrally positioned hub (84) within the second bushing (36). The hub (84) itself may be substantially cylindrical piece having a solid or a hollow interior portion. In certain embodiments, the hub (84) includes a substantially cylindrical outer frame and a hollow interior portion. In further embodiments, the spokes (82) may laterally extend past the outer frame of the substantially cylindrical hub (84) towards the second end (open end) of the second bushing (36). In further embodiments, the lateral extension of the spokes (82) are tapered between the inner wall (97) and the edge of the outer frame of the substantially cylindrical hub (84). Together, the substantially cylindrical hub (84) and the spokes (82) which include a lateral and tapered extension past the outer frame of the hub (84) inner wall (97) and the edge of the outer frame of the hub (84) forms a cradle which can rest upon the first end of the second bearing (30). More specifically, the second end (68) of the second bearing (30) includes a cylinder (65) which may inserted or positioned within the internal hollow portion of the cylindrical hub (84). This arrangement also allows the shoulder (62) on the second bearing (30) to contact the edge of the outer frame of the substantially cylindrical hub (84). When the second bushing (36) is engaged to the second end of the roller or cage (26), this arrangement further prevents the roller or cage (26) from sliding towards the third bend of the wire frame (20) opposite the second end of the wire frame (20).

The second bushing (36) may be engaged to the second end of the roller or cage (26) through any means within the sound judgment of those of skill in the art. For example, the second bushing (36) may be threadably or adhesively engaged to the second end of the roller or cage (26) With reference to FIGS. 21 and 22, the second bushing (36) is engaged to the second end of the roller or cage (26) through a snap configuration between the second bushing (36) and the second end of the roller or cage (26). The snap configuration may be achieved by an internal protrusion (109) along the inner surface of the inner wall (97) of the second bushing (36) and a recess (60) positioned at the first end of the cage as shown in FIG. 11. In certain embodiments, this internal protrusion (109) extends along the inner circumference of the interior wall (97) of the first bushing (34) and the recess (60) extends along the outer circumference at a cylindrical portion of the second end of the roller or cage (26). The second bushing (36), when engaged to the second end of the second horizontal portion of the roller or cage (26), prevents the roller or cage (26) from sliding towards the third bend of the wire frame (20) and secures the roller or cage (26) onto the second horizontal portion of the wire frame (20).

With reference to FIGS. 23 and 25, the cylindrical body (93) of the second bushing (36) may have a smooth surface and the closed end (103) of the second bushing (36) may also have a smooth surface without any apertures.

In certain embodiments at least one of the first bushing (34) and second bushing (36) may have a "trumpet" or frusto-conical shape. In such embodiments, the outer diameter of the first end (87) of the first bushing (34) may be greater than the outer diameter of the second end (89) of the first bushing (34) and/or the outer diameter of the first end (99) of the second bushing (36) may be greater than the outer diameter of the second end (101) of the second bushing (36). Such embodiments of the bushing may limit paint ingress along the ends of the roller cover and may also assist in preventing the roller cover from walking off the roller assembly (10) as it is being used.

The combination of the first and second bearings (28) and (30) being "pinned" to the wire frame (20) while also being connected with corresponding first and second bushings (34) and (36) which engages the roller or cage (26) allows for the roller or cage (26) and the first and second bushings to spin or rotate relative to the wire frame (20) without allowing for the bearings (28) and (30) to spin along the wire frame (20). Rather, the roller or cage (26) spins along the first and second bearings (28) and (30) which remain in locked position to the wire frame (20). By utilizing embodiments where the bearings do not rotate along the wire frame, abrasion and wearing away of the bearings, including bearing paint and bearing material, does not occur. In roller assemblies which do not utilize fixed bearings, abrasion of the bearings can result in contaminants running along the wire frame of the roller assembly and ultimately into the wet paint that is to be applied to a surface. Such abrasion and wearing away of the bearings of other roller assemblies have been observed as gray streaks along the wire frame and in the wet paint that is to be applied.

With reference to FIG. 40 at least one of the first and second bearing (28) and (30) may include slots or holes (110) within the cylinder (65) of the bearing. These slots or holes (110) may function to scrape dried paint that may find its way and accumulate within the inner surface of the first or second bushing (34) and (36). This dried paint can hinder rotation of the roller or cage (26). By incorporating slots or holes (110) within the cylinder (65) of the bearing, dried paint can be scraped from the inner surface of the bushing thereby freeing rotation of the roller or cage (26).

Also provided is a method of assembling a roller assembly (10). The method may include the following steps: forming a wire frame having a first end and a second end; forming a first aperture and a second aperture positioned at a first end and a second end of the second horizontal portion at the second end of the wire frame; engaging a first end of a handle to the first end of the wire frame; positioning a first bushing having an open end and a closed end over a first end of the second horizontal portion at the second end of the wire frame, wherein the first bushing includes an aperture within its closed end that allows it to be positioned at the first end of the second horizontal portion at the second end of the wire frame; aligning a first bearing with the first aperture at the second horizontal portion at the second end of the wire frame and engaging the first bearing to the wire frame;

aligning a second bearing with the second aperture at the second horizontal portion at the second end of the wire frame and engaging the second bearing to the wire frame; positioning a cage having a first end and a second end over the second horizontal portion at the second end of the wire frame and engaging the first end of the cage to the first bushing; and positioning a second bushing over the second horizontal portion at the second end of the wire frame and engaging the second bushing to the second end of the cage.

Numerous embodiments have been described herein. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

What is claimed is:

1. A paint roller comprising:

a wire frame having a first end and a second end, wherein the first end of the wire frame extends from a first longitudinal portion to a first bend, which extends to a first horizontal portion, which extends to a second bend, which extends to a second longitudinal portion, which extends to a third bend, which extends to a second horizontal portion at the second end of the wire frame;

a handle having a first end and a second end wherein the first end of the handle is engaged to the first end of the wire frame;

a first aperture and a second aperture positioned at a first end and a second end of the second horizontal portion at the second end of the wire frame;

a first bearing having a first internal chamber which is aligned with the first aperture of the wire frame and a second internal chamber substantially perpendicular to the first internal chamber which receives a portion of the wire frame;

a second bearing having a first internal chamber which is aligned with the second aperture of the wire frame and a second internal chamber substantially perpendicular to the first internal chamber which receives a portion of the wire frame;

a first pin inserted through the first internal chamber of the first bearing and the first aperture on the wire frame;

a second pin inserted through the first internal chamber of the second bearing and the second aperture on the wire frame;

a first bushing having a substantially cylindrical body having an outer wall and an inner wall defining an internal chamber, a closed end and an open end, wherein the first bushing includes an aperture within the closed end that allows it to be positioned at the first end of the second horizontal portion at the second end of the wire frame;

a second bushing having a substantially cylindrical body having an outer wall and an inner wall defining an internal chamber a closed end and an open end, wherein the second bushing is positioned at the second end of the second horizontal portion at the second end of the wire frame; and a roller having a first end and a second end, wherein the roller is engaged to the second horizontal portion at the second end of the wire frame through the first and second bearing and the first and second bushing.

2. The paint roller of claim 1, wherein the roller is shape of a cylindrical piece having a first end, a second end and a cylindrically consistent smooth surface, wherein the roller has a radially expanded portion at its first end and a radially expanded portion at its second end relative to its interior portion and wherein the first and second ends of the roller respectively engage a first and second bushing.

3. The paint roller of claim 1, wherein the roller is a cage having at least two lateral elements and at least two circular elements substantially perpendicular to the lateral elements, wherein one circular element is positioned at the first end and one circular element is positioned at the second end of the cage, a first rim adjacent to the circular element at the first end of the cage, and a second rim adjacent to the circular element at the second end of the cage.

4. The paint roller of claim 3, wherein the cage comprises four lateral elements and six circular elements substantially perpendicular to the lateral elements wherein one circular element is positioned at the first end of the cage and one circular element is positioned at the second end of the cage, wherein the lateral elements are spaced at equidistant points relative to each other along the cage and wherein the circular elements are spaced at equidistant points relative to each other along the cage.

5. The paint roller of claim 4, wherein the rim at the first end of the cage includes a recess along the circumference of the rim which allows for the first end of the cage to engage an internal protrusion along the inner wall of the first bushing and wherein the rim at the second end of the cage includes a recess along the circumference of the rim which allows for the second end of the cage to engage an internal protrusion along the inner wall of the second bushing.

6. The paint roller of claim 5, wherein a first circular element at the first end of the cage and a second circular element at the second end of the cage has an increased diameter relative to the circular elements positioned internally along the body of the cage and wherein the lateral elements are tapered outwardly at the first and second ends of the cage to connect to the first circular element at the first end of the cage and the second circular element at the second end of the cage.

7. The paint roller of claim 6, wherein the outer wall of the cylindrical body of the first bushing comprises external ribs spaced at various points along the outer wall.

8. The paint roller of claim 7, wherein the closed end of the first bushing comprises a cylindrical cover having a diameter that is greater than the diameter of the cylindrical body of the first bushing so that the cylindrical cover forms a substantially circular rim over the cylindrical body and wherein the external ribs on the cylindrical body of the first bushing extend short of the cylindrical cover forming a gap between the circular rim and the external ribs.

9. The paint roller of claim 1, wherein the handle comprises a first projecting edge and a second projecting edge both of which are positioned at the first end of the handle.

10. The paint roller of claim 9, wherein the second end of the handle is engaged to an insert comprising an insert body having an interior chamber, a first end and a second end; wherein the first end of the insert is engaged to the handle and the second end of the insert functions as an adapter designed to engage an extension pole system.

11. The paint roller of claim 10, wherein the insert comprises an insert flange having a top portion and a bottom portion, wherein the top portion of the insert flange comprises at least one U-shaped recess and the bottom portion of the insert flange comprises concave features.

12. The paint roller of claim 11, wherein the U -shaped recess on the top portion of the insert flange form holes into which an actuator pin of an extension pole system may engage and wherein the concave features on the bottom portion of the insert flange are designed to prevent relative rotation of the extension pole system with the insert when the extension pole system is engaged to the insert.

13. The paint roller of claim 12, wherein the insert includes two areas of insert ribs that extend axially on the top and bottom of the interior of the insert and two areas of smooth surfaces that extend axially on the interior sides of the insert which are designed to engage an extension pole system.

14. The paint roller of claim 1, wherein the first bearing and the second bearing comprise a shoulder portion adjacent to the cylindrical portion of the second internal chamber.

15. The paint roller of claim 14, wherein the internal chamber of the first and second bushing includes at least two spokes extending from a centrally positioned hub.

16. The paint roller of claim 15, wherein the hub of the first and second bushing comprises a substantially cylindrical frame having a hollow interior.

17. The paint roller of claim 16, wherein the hub of the first bushing is capable of receiving the cylindrical portion of the second internal chamber of the first bearing and wherein the hub of the second bushing is capable of receiving the cylindrical portion of the second internal chamber of the second bearing.

18. The paint roller of claim 17, wherein the frame of the hub of the first bushing is capable of contacting the shoulder portion of the first bearing and the frame of the hub of the second bushing is capable of contacting the shoulder portion of the second bearing.

19. The paint roller of claim 18, wherein the first bushing and the second bushing have a frusto-conical shape.

20. A method of assembling a paint roller comprising:

forming a wire frame having a first end and a second end, wherein the first end of the wire frame extends from a first longitudinal portion to a first bend, which extends to a first horizontal portion, which extends to a second bend, which extends to a second longitudinal portion, which extends to a third bend, which extends to a second horizontal portion at the second end of the wire frame;

forming a first aperture and a second aperture positioned at a first end and a second end of the second horizontal portion at the second end of the wire frame;

engaging a first end of a handle to the first end of the wire frame;

positioning a first bushing over a first end of the second horizontal portion at the second end of the wire frame wherein the first bushing comprises a substantially cylindrical body having an outer wall and an inner wall defining an internal chamber, a closed end and an open end, wherein the internal chamber of the first bushing includes at least two spokes extending from a centrally positioned hub, wherein the hub comprises a substantially cylindrical frame having a hollow interior and wherein the first bushing includes an aperture within the closed end that allows it to be positioned at the first end of the second horizontal portion at the second end of the wire frame;

aligning a first bearing with the first aperture at the second horizontal portion at the second end of the wire frame and engaging the first bearing to the wire frame;

aligning a second bearing with the second aperture at the second horizontal portion at the second end of the wire frame and engaging the second bearing to the wire frame;

positioning a roller having a first end and a second end over the second horizontal portion at the second end of the wire frame and engaging the first end of the roller to the first bushing;

positioning a second bushing over the second horizontal portion at the second end of the wire frame and engaging the second bushing to the second end of the roller, wherein the second bushing comprises a substantially cylindrical body having an outer wall and an inner wall defining an internal chamber a closed end and an open end, wherein the internal chamber of the second bushing includes at least two spokes extending from a centrally positioned hub, wherein the hub comprises a substantially cylindrical frame having a hollow interior and which is capable of receiving the cylindrical portion of the second internal chamber of the second bearing and further wherein the frame of the hub is capable of contacting the shoulder portion of the second bearing.

21. A paint roller comprising:

a wire frame having a first end and a second end, wherein the first end of the wire frame extends from a first longitudinal portion to a first bend, which extends to a first horizontal portion, which extends to a second bend, which extends to a second longitudinal portion, which extends to a third bend, which extends to a second horizontal portion at the second end of the wire frame;

a handle having a first end and a second end wherein the first end of the handle is engaged to the first end of the wire frame, wherein the handle comprises a first projecting edge and a second projecting edge both of which are positioned at the first end of the handle, wherein the second end of the handle is engaged to an insert comprising an insert body having an interior chamber, a first end and a second end; wherein the second end is engaged to the handle and the first end functions as an adapter designed to engage an extension pole system, wherein the insert comprises an insert flange having a top portion and a bottom portion, wherein the top portion of the insert flange comprises at least one U-shaped recess and the bottom portion of the insert flange comprises concave features, wherein the U-shaped recess on the top portion of the insert flange form holes into which an actuator pin of an extension pole system may engage and wherein the concave features on the bottom portion of the insert flange are designed to prevent relative rotation of an extension pole system with the insert when the extension pole system is engaged to the insert, and wherein the insert includes two areas of insert ribs that extend axially on the top and bottom of the interior of the insert and two areas of smooth surfaces that extend axially on the interior sides of the insert which are designed to engage an extension pole system;

a first aperture and a second aperture positioned at a first end and a second end of the second horizontal portion at the second end of the wire frame;

a first bearing having a first internal chamber, a second internal chamber formed from a cylindrical portion, and a shoulder portion adjacent to the cylindrical portion of the second internal chamber, wherein the first internal chamber is aligned with the first aperture of the wire frame;

a second bearing having a first internal chamber, a second internal chamber formed from a cylindrical portion, and a shoulder portion adjacent to the cylindrical portion of the second internal chamber, wherein the first internal chamber is aligned with the second aperture of the wire frame;

a first pin inserted through the first internal chamber of the first bearing and the first aperture on the wire frame;

a second pin inserted through the first internal chamber of the second bearing and the second aperture on the wire frame;

a cage having a first end and a second end, four lateral elements and six circular elements substantially perpendicular to the lateral elements, wherein one circular element is positioned at the first end of the cage and one circular element is positioned at the second end of the cage, wherein the lateral elements are spaced at equidistant points relative to each other along the cage and wherein the circular elements are spaced at equidistant points relative to each other along the cage, a first rim adjacent to the circular element at the first end of the cage, and a second rim adjacent to the circular element at the second end of the cage, wherein the cage is engaged to the second horizontal portion at the second end of the wire frame, wherein the rims at the first end and second end of the cage includes a recess along the circumference of the rim, wherein a first circular element at the first end of the cage and a second circular element at the second end of the cage has an increased diameter relative to the circular elements positioned internally along the body of the cage and wherein the lateral elements are tapered outwardly at the first and second ends of the cage to connect to the first circular element at the first end of the cage and the second circular element at the second end of the cage;

a first bushing having a substantially cylindrical body having an outer wall and an inner wall defining an internal chamber, a closed end and an open end, wherein the internal chamber of the first bushing includes at least two spokes extending from a centrally positioned hub, wherein the hub comprises a substantially cylindrical frame having a hollow interior and which is capable of receiving the cylindrical portion of the second internal chamber of the first bearing and further wherein the frame of the hub is capable of contacting the shoulder portion of the first bearing, wherein the outer wall of the cylindrical body of the first bushing comprises external ribs spaced at various points along the outer wall, wherein the closed end of the first bushing comprises a cylindrical cover having a diameter that is greater than the diameter of the cylindrical body of the first bushing so that the cylindrical cover forms a substantially circular rim over the cylindrical body, and wherein the external ribs on the cylindrical body of the first bushing extend short of the cylindrical cover forming a gap between the circular rim and the external ribs; and, a second bushing having a substantially cylindrical body having an outer wall and an inner wall defining an internal chamber a closed end and an open end, wherein the internal chamber of the second bushing includes at least two spokes extending from a centrally positioned hub, wherein the hub comprises a substantially cylindrical frame having a hollow interior and which is capable of receiving the cylindrical portion of the second internal chamber of the second bearing and further wherein the frame of the hub is capable of contacting the shoulder portion of the second bearing, wherein the recess on the rims of the first and second ends of the cage allows for the first end of the cage to engage an internal protrusion along the inner wall of the first bushing and the second end of the cage to engage an internal protrusion along the inner wall of the second bushing.

* * * * *